US009459567B2

(12) United States Patent
Momma et al.

(10) Patent No.: US 9,459,567 B2
(45) **Date of Patent: *Oct. 4, 2016**

(54) FIXING DEVICE AND IMAGE FORMING APPARATUS

(71) Applicant: RICOH COMPANY, LTD., Tokyo (JP)

(72) Inventors: Susumu Momma, Kanagawa (JP); Koji Masuda, Kanagawa (JP); Hidemasa Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/477,168

(22) Filed: Sep. 4, 2014

(65) Prior Publication Data

US 2015/0078767 A1 Mar. 19, 2015

(30) Foreign Application Priority Data

Sep. 17, 2013 (JP) ..... 2013-191490

(51) Int. Cl.
*G03G 15/20* (2006.01)
*G03G 21/16* (2006.01)

(52) U.S. Cl.
CPC ..... *G03G 15/2032* (2013.01); *G03G 21/1685* (2013.01)

(58) Field of Classification Search
CPC ... G03G 15/20; G03G 15/55; G03G 21/1685
USPC ..... 399/33, 67, 68, 328, 329
See application file for complete search history.

(56) References Cited

U.S. PATENT DOCUMENTS

| | | | | |
|---|---|---|---|---|
| 2009/0196642 | A1* | 8/2009 | Condello | G03G 15/2053 399/68 |
| 2009/0238590 | A1 | 9/2009 | Masuda | |
| 2010/0008686 | A1 | 1/2010 | Masuda et al. | |
| 2010/0266302 | A1 | 10/2010 | Suzuki et al. | |
| 2010/0310284 | A1 | 12/2010 | Funato et al. | |
| 2011/0043810 | A1 | 2/2011 | Suzuki et al. | |
| 2011/0044713 | A1 | 2/2011 | Masuda et al. | |

(Continued)

FOREIGN PATENT DOCUMENTS

| | | |
|---|---|---|
| JP | 05-113739 | 5/1993 |
| JP | 2006-251165 | 9/2006 |
| JP | 2007-034068 | 2/2007 |

OTHER PUBLICATIONS

U.S. Appl. No. 14/208,621, filed Mar. 13, 2014.

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P

(57) ABSTRACT

A fixing device that fixes a toner image carried on a transfer sheet onto the transfer sheet includes a fixing belt that relatively moves, with its surface being in contact with the toner image during the fixing operation, with respect to the transfer sheet, surface information detecting devices that determine surface information of the fixing belt, a surface condition changing roller that is arranged so as to be capable of coming into contact with and separating from the fixing belt and abrades the surface of the fixing belt in contact with the fixing belt, and a surface condition changing controller that controls the contact and separation of the surface condition changing roller with and from the fixing belt based on detection results obtained by the surface information detecting devices.

11 Claims, 19 Drawing Sheets

(56) References Cited

U.S. PATENT DOCUMENTS

| | | | | |
|---|---|---|---|---|
| 2011/0135324 | A1* | 6/2011 | Peng et al. | 399/16 |
| 2012/0268750 | A1 | 10/2012 | Masuda | |
| 2013/0216267 | A1 | 8/2013 | Masuda et al. | |
| 2013/0243446 | A1 | 9/2013 | Masuda | |
| 2013/0243458 | A1 | 9/2013 | Suzuki et al. | |
| 2013/0251389 | A1 | 9/2013 | Suzuki et al. | |
| 2013/0308966 | A1 | 11/2013 | Masuda et al. | |
| 2014/0023391 | A1 | 1/2014 | Masuda | |
| 2014/0044460 | A1 | 2/2014 | Kudo et al. | |
| 2014/0071443 | A1 | 3/2014 | Suzuki et al. | |
| 2014/0219670 | A1 | 8/2014 | Masuda et al. | |

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2013-191490 filed in Japan on Sep. 17, 2013.

BACKGROUND OF THE INVENTION

1. Field of the Invention

The present invention relates to a fixing device and an image forming apparatus, and in particular, to a fixing device that fixes toner images onto a sheet-shaped recording medium and an image forming apparatus including the fixing device.

2. Description of the Related Art

An image forming apparatus is known that includes an image carrier, an exposure device that irradiates the image carrier with modulated light to form a latent image, a developing device that causes toner to adhere to the latent image to produce a toner image, a transfer device that transfers the toner image onto a recording medium, and a fixing device including a fixing belt that fixes the toner image onto a sheet-shaped recording medium and the image forming apparatus forms an image onto the sheet-shaped recording medium.

An apparatus is known as one of this kind of image forming apparatuses that abrades the surface of a fixing belt to expose a new surface, thereby improving the surface condition of the fixing belt and improving image quality (refer to Japanese Patent Application Laid-open No. 2007-34068, for example).

However, the image forming apparatus disclosed in Japanese Patent Application Laid-open No. 2007-34068 had a problem in that the surface of the fixing belt was abraded, and the life of the fixing belt was shortened.

SUMMARY OF THE INVENTION

It is an object of the present invention to at least partially solve the problems in the conventional technology.

The present invention provides a fixing device that fixes a toner image carried on a sheet-shaped recording medium onto the sheet-shaped recording medium, the fixing device including: a fixing member that relatively moves, with a surface thereof being in contact with the toner image during fixing operation, in a first direction with respect to the sheet-shaped recording medium; a surface information detecting device that determines surface information of the fixing member; a surface condition changing device that is arranged so as to be capable of coming into contact with and separating from the fixing member and abrades the surface of the fixing member in contact with the fixing member; and a surface condition changing controller that controls contact and separation of the surface condition changing device with and from the fixing member based on a detection result obtained by the surface information detecting device. The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1A:
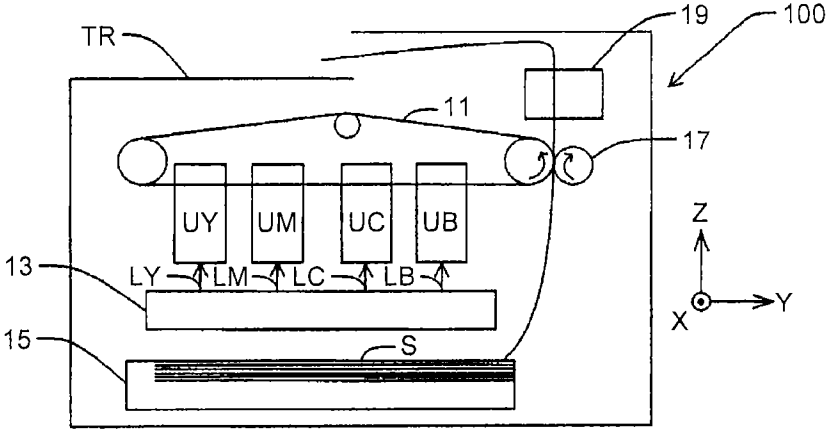
FIG. 1A is a diagram illustrating the schematic constitution of a color printer according to an embodiment of the present invention.

The following describes an embodiment of the present invention with reference to FIG. 1A to FIG. 21. FIG. 1A schematically illustrates a color printer 100 as an example of the image forming apparatus. The color printer 100 according to the present embodiment is what is called a tandem type printer. The color printer 100 includes a transfer belt 11, an optical scanner 13, a cassette 15, a secondary transfer roller 17, a fixing device 19, and image forming units UY, UM, UC, and UB. As described below, the optical scanner 13 scans and exposes photosensitive drums included in the image forming units UY to UB with scanning light LY to LB. The following description is given with the main-scanning direction of scanning light LY to LB as an X-axial direction, with the vertical direction as a Z-axial direction, and with the direction perpendicular to the X axis and Z axis as a Y-axial direction.

The transfer belt 11 as an intermediate transfer body is trained around a plurality of (three, for example, in the present embodiment) rollers. The transfer belt 11 is driven by a driving roller as one of the three rollers, for example, and rotates counterclockwise with respect to the paper plane. A part of the transfer belt 11 under the paper plane is stretched in a planar manner so as to be parallel to a given two-dimensional plane (the horizontal plane, for example).

The image forming units UY, UM, UC, and UB are arranged in a region through which the part of the transfer belt 11 stretched in a planar manner passes. Y, M, C, and B in the symbols represent colors of yellow, magenta, cyan, and black, respectively. The image forming unit UY is a unit for forming a yellow image, the image forming unit UM is a unit for forming a magenta image, the image forming unit UC is a unit for forming a cyan image, and the image forming unit UB is a unit for forming a black image.

The optical scanner 13 as an image writing device is arranged below (on the −Z side of) the image forming units UY to UB, and the cassette 15 is arranged further therebelow.

Figure 1B:
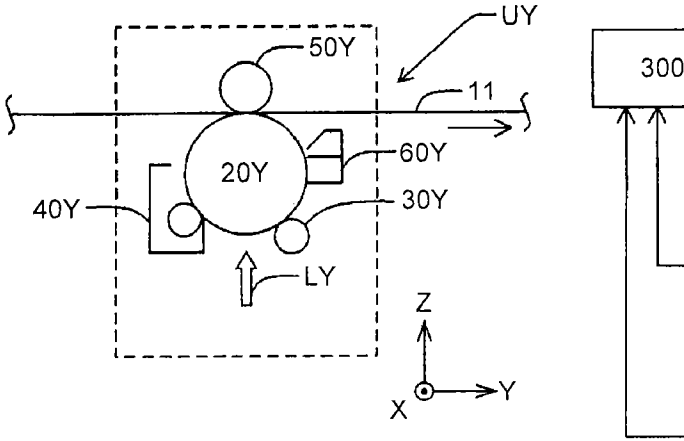
FIG. 1B is a diagram illustrating the schematic constitution of an image forming unit included in the color printer in FIG. 1A.

The structures of the image forming units UY to UB are substantially the same and are described briefly with reference to FIG. 1B by taking the image forming unit UY as an example.

As illustrated in FIG. 1B, the image forming unit UY includes a photosensitive drum 20Y as a photoconductive photosensitive body, and arranged around the photosensitive drum 20Y are a charger 30Y as a contact charging roller, a developing unit 40Y as an image writing unit by the scanning light LY, a transfer roller 50Y, and a cleaning unit 60Y. The transfer roller 50Y is arranged facing the photosensitive drum 20Y through the transfer belt 11 and is in contact with the back side of the transfer belt 11. In FIG. 1B, the broken-line rectangle collectively illustrates the unit of the imaging unit UY and does not necessarily illustrate the substance of a casing, for example.

The other image forming units UM to UB illustrated in FIG. 1A are constituted in the same manner as the image forming unit UY. The following description is given to photosensitive drums 20M to 20B, chargers 30M to 30B, developing units 40M to 40B, transfer rollers 50M to 50B, and cleaning units 60M to 60B as components included in the image forming units UM to UB, although they are not illustrated. The following description is given to the beams of scanning light LM to LB (refer to FIG. 1A) as beams of scanning light for the image forming units UM to UB, respectively.

Next, the process of color image printing by the color printer 100 will be briefly described.

When the process of color image formation starts, the photosensitive drums 20Y to 20B and the transfer belt 11 (refer to FIG. 1B) start to rotate. The rotation direction of the photosensitive drums 20Y to 20B is clockwise with respect to the paper plane, whereas the rotation direction of the transfer belt 11 is counterclockwise with respect to the paper plane (refer to the arrow in FIG. 1B).

Photosensitive surfaces of the photosensitive drums 20Y to 20B are uniformly charged by the chargers 30Y to 30B, respectively. The optical scanner 13 (refer to FIG. 1A) performs image writing by optically scanning with the beams of scanning light LY to LB for the photosensitive drums 20Y to 20B, respectively. Various types have been known as the optical scanner 13 that performs such image writing, and these known ones are appropriately used as the optical scanner 13.

For the photosensitive drum 20Y, optical scanning is performed with a laser beam whose intensity is modulated in accordance with a yellow image as the scanning light LY. This causes the yellow image to be written onto the photosensitive drum 20Y, thereby forming an electrostatic latent image corresponding to the yellow image. The formed electrostatic latent image is what is called a negative latent image, which is visualized as a yellow toner image through reversal development using yellow toner by the developing unit 40Y. The visualized yellow toner image is electrostatically primarily transferred to the front side of the transfer belt 11 by the transfer roller 50Y.

For the photosensitive drum 20M, optical scanning is performed with a laser beam whose intensity is modulated in accordance with a magenta image as the scanning light LM. This causes the magenta image to be written onto the photosensitive drum 20M, thereby forming an electrostatic latent image (a negative latent image) corresponding to the magenta image. The formed electrostatic latent image is visualized as a magenta toner image through reversal development using magenta toner by the developing unit 40M.

For the photosensitive drum 20C, optical scanning is performed with a laser beam whose intensity is modulated in accordance with a cyan image as the scanning light LC. This causes the cyan image to be written onto the photosensitive drum 20C, thereby forming an electrostatic latent image (a negative latent image) corresponding to the cyan image. The formed electrostatic latent image is visualized as a cyan toner image through reversal development using cyan toner by the developing unit 40C.

For the photosensitive drum 20B, optical scanning is performed with a laser beam whose intensity is modulated in accordance with a black image as the scanning light LB. This causes the black image to be written onto the photosensitive drum 20B, thereby forming an electrostatic latent image (a negative latent image) corresponding to the black image. The formed electrostatic latent image is visualized as a black toner image through reversal development using black toner by the developing unit 40B.

The magenta toner image is electrostatically primarily transferred to the transfer belt 11 by the transfer roller 50M, and at this time, the magenta toner image is superimposed on the yellow toner image transferred to the transfer belt 11 earlier. Similarly, the cyan toner image is superimposed on the yellow toner image and the magenta toner image transferred to the transfer belt 11 earlier by the transfer roller 50C to be primarily transferred. The black toner image is superimposed on the yellow, magenta, and cyan toner images on the transfer belt 11 by the transfer roller 50B to be primarily transferred.

The toner images with four colors of yellow, magenta, cyan, and black are thus superimposed on the transfer belt 11 to form a color toner image. The cleaning units 60Y to 60B clean the photosensitive drums 20Y to 20B, respectively, after the toner image transfer, thereby removing residual toner or paper powder, or the like.

Transfer sheets S are housed in the cassette 15 in a stacked manner. The transfer sheet S is fed by a known sheet feeding mechanism (not illustrated), waits with its leading edge held by a timing roller (also referred to as a registration roller), and is fed to a secondary transfer unit in synchronization with the movement of the color toner image on the transfer belt 11. The secondary transfer unit means an abutment part between the transfer belt 11 and the secondary transfer roller 17 that is in contact therewith and rotates together therewith. In synchronization with the arrival of the color toner image on the transfer belt 11 in the secondary transfer unit, the transfer sheet S is fed to the secondary transfer unit by the timing roller.

Thus, the color toner image and the transfer sheet S are overlaid on each other, and the color toner image is electrostatically transferred (secondarily transferred) onto the transfer sheet S. The transfer sheet S onto which the color toner image has been secondarily transferred passes through the fixing device 19. In this situation, the fixing device 19 fixes the color toner image onto the transfer sheet S. The transfer sheet S is then discharged onto a tray TR in the upper part of the color printer 100.

The foregoing is a brief description of the process of color image printing by the color printer 100. Specifically, the color printer 100 illustrated in FIG. 1A is an image forming apparatus that forms one or more types of toner images (yellow to black toner images) by the electrophotographic process, transfers these toner images onto the transfer sheet S, and fixes the toner images (the color toner image) carried by the transfer sheet S onto the transfer sheet S by the fixing device 19.

Figure 1C:
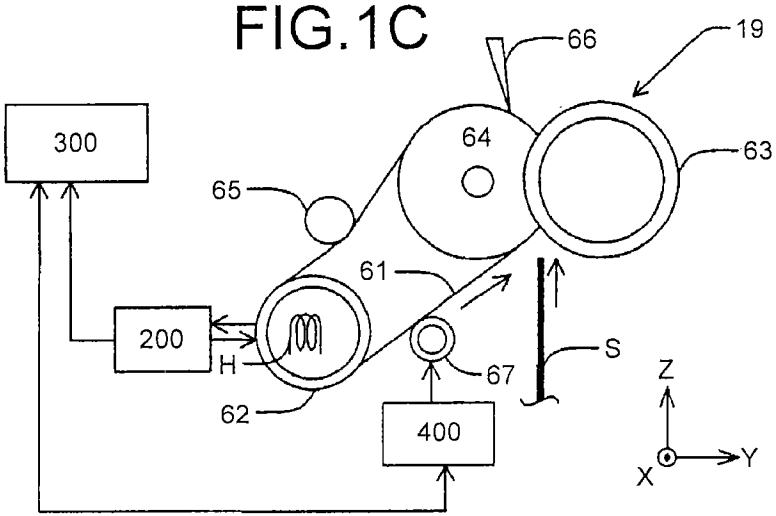
FIG. 1C is a diagram illustrating the schematic constitution of a fixing device included in the color printer in FIG. 1A.

Described next with reference to FIG. 1C is the structure of the fixing device 19 included in the color printer 100 illustrated in FIG. 1A. The fixing device 19 is what is called a belt fixing type fixing device. In its part performing fixing, the device includes a heating roller 62, a pressing roller 63, a fixing roller 64, a tension roller 65, separating claws 66, and a surface condition changing roller 67 together with a fixing belt 61 as a fixing member.

The fixing belt 61 includes a base material (base layer) formed of nickel, polyimide, or the like, a releasing layer formed of a tetrafluoroethylene-perfluoroalkylvinyl ether resin (PFA), polytetrafluoroethylene (PTFE), or the like, and an elastic layer formed of silicone rubber or the like between the base material and the releasing layer. The surface of the fixing belt 61 is thus formed of resin such as PFA and PTFE forming the releasing layer, and the surface is a plane as an object of flaw detection described below.

The fixing belt 61, which is an endless belt, is trained around the heating roller 62 and the fixing roller 64 and is given certain tension (necessary tension) by the tension roller 65. The heating roller 62 is a hollow roller formed of, for example, aluminum (or iron) and incorporates therein a heat source H such as a halogen heater. The heating roller 62 heats the fixing belt 61 with the heat source H. Although not illustrated, a temperature sensor (such as a thermopile) for detecting the surface temperature of the fixing belt 61 is arranged around the surface of the fixing belt 61 in a noncontact manner. In place of the noncontact temperature sensor, a contact temperature sensor (a thermister) may be used.

The fixing roller 64 includes a core metal and an elastic layer such as silicone rubber formed thereon. The fixing roller 64 rotatingly drives the fixing belt 61 counterclockwise. The pressing roller 63 includes a core metal such as aluminum and iron, an elastic layer such as silicone rubber formed thereon, and a releasing layer such as PFA and PTFE as a surface layer. The pressing roller 63 makes pressurized contact with the fixing belt 61 at a position facing the fixing roller 64. This pressurized contact deforms the fixing roller 64 to form a nip part. This nip part forms a fixing unit for the color toner image electrostatically secondarily transferred to the transfer sheet S.

The tension roller 65 contains a core metal and an elastic layer such as silicone rubber formed thereon. The separating claws 66 are arranged plurally in the axial direction of the fixing roller 64 (the direction perpendicular to the paper plane), and its leading edge abuts on the surface of the fixing belt 61.

The surface condition changing roller 67 includes a core metal and a surface layer having certain roughness formed thereon. The surface layer has asperities of the order of 10 μm, for example. When the surface condition changing roller 67 is rotated in contact with the surface of the fixing belt 61, the surface of the fixing belt 61 is abraded by rubbing between the fixing belt 61 and the surface condition changing roller 67, thereby exposing a new surface. The surface condition changing roller 67 can come into contact with and separate from the fixing belt 61 as described below.

In the fixing device 19, when the color toner image is fixed onto the transfer sheet S, the fixing belt 61 is rotated counterclockwise with respect to the paper plane while being heated by the heat source H, and the pressing roller 63 rotates clockwise with respect to the paper plane. When the surface temperature of the fixing belt 61 reaches a given fixable temperature, the transfer sheet S onto which the color toner image has been transferred is conveyed in the arrow direction in FIG. 1C to enter the fixing unit (nip unit). The color toner image receives heat from the fixing belt 61 and is pressed by the pressing roller 63 against the fixing belt 61 to receive pressure in the fixing unit, thereby being fixed onto the transfer sheet S.

Although not illustrated, the color printer 100 includes a cleaning device for cleaning the transfer belt 11 (refer to FIG. 1A). This cleaning device includes a cleaning brush and a cleaning blade arranged so as to abut on the transfer belt 11 facing the part in which the transfer belt 11 is trained around the roller and scrapes off and removes foreign objects such as residual toner and paper powder on the transfer belt 11 on the left hand of the image forming unit UY with respect to the paper plane in FIG. 1A, thereby cleaning the transfer belt 11. The cleaning device also includes a discharge unit that carries out and discards the residual toner removed from the transfer belt 11.

The cut part (edge part) of the transfer sheet S is sharp and granular additives (calcium carbonate, for example) may be exposed. Owing to this, in the fixing device 19, linear flaws and the like occur on the surface of the fixing belt 61, which is originally free from flaws, caused by rubbing with the transfer sheet S along with the repetition of the fixing operation. In the fixing device 19, what is called offset (adhesion of toner to the fixing belt 61) occurs on the surface of the fixing belt 61 along with the repetition of the fixing operation. The linear flaws can also occur by the contact with the separating claws 66 and the like. The linear flaws can easily occur when the sheet-shaped recording medium is a plastic sheet for overhead projectors. The presence or absence of offset and the degree of offset and the condition and position of flaws on the surface of the fixing belt 61 will be collectively referred to as surface information of the fixing belt 61 below.

The fixing device 19 includes a surface information detecting device for detecting the surface information of the fixing belt 61. The surface information detecting device includes, on the surface of the fixing belt 61, a reflective optical sensor 200 that irradiates the fixing belt 61 with laser light and receives the reflected light of the laser light and a surface information detector 300 that detects the surface information of the fixing belt 61 based on the detection results obtained by the reflective optical sensor 200.

The reflective optical sensor 200 is arranged at a part facing the part of the fixing belt 61 trained around the heating roller 62. The reflective optical sensor 200 includes an irradiation unit that applies a plurality of beams of laser light toward the surface of the fixing belt 61 in a direction parallel to the width direction of the fixing belt 61 and a sensor unit that receives the reflected beams of laser light from the fixing belt 61 (the irradiation unit and the sensor unit are not illustrated in FIG. 1C). It is noted that the constitution and operation of the reflective optical sensor 200 will be described in detail below. The width direction of the fixing belt 61 is parallel to the main-scanning direction for the image writing with the scanning light LY to LB (refer to FIG. 1A), and thus the width direction of the fixing belt 61 is also referred to as the main-scanning direction.

The surface information detector 300 is arranged within the color printer 100 (refer to FIG. 1A). The surface information detector 300 is connected to the reflective optical sensor 200 and receives detection signals from the reflective optical sensor 200, thereby detecting the surface condition of the fixing belt 61 as the surface information. The surface information detector 300 also has the function of controlling the operation of the reflective optical sensor 200.

Figure 2:
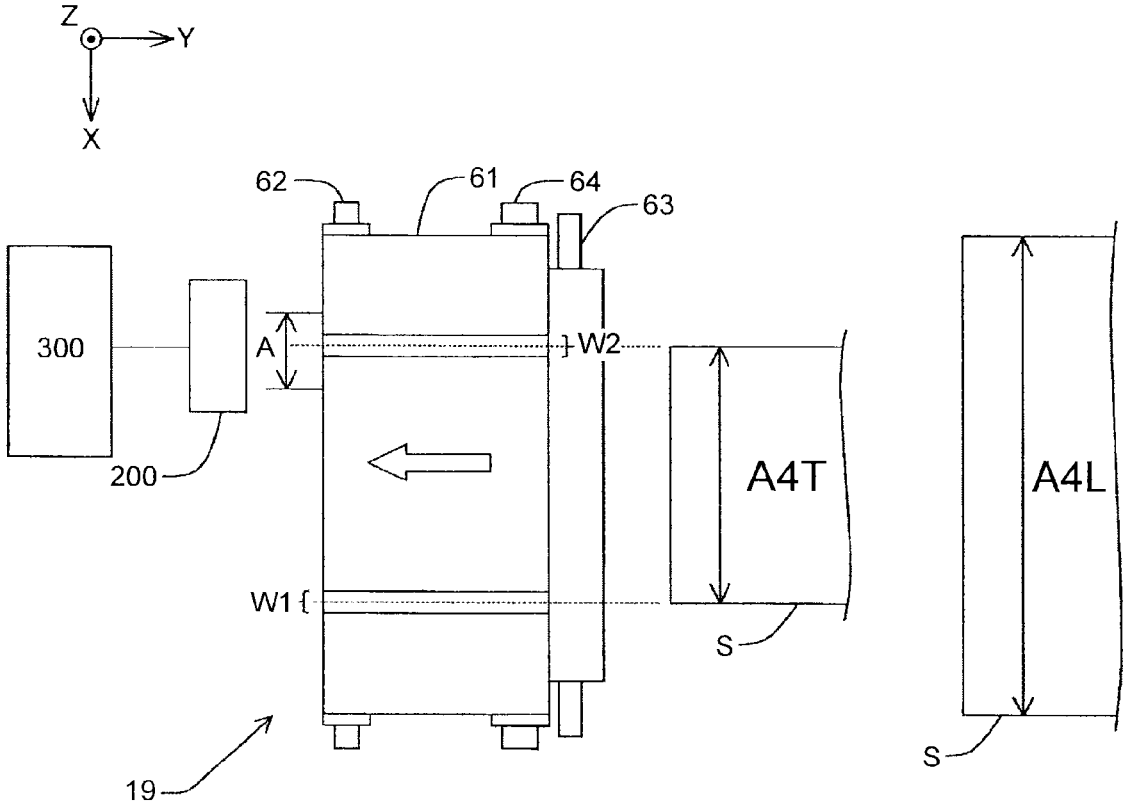
FIG. 2 is a diagram illustrating the relation between the fixing device and a transfer sheet.

FIG. 2 schematically illustrates the fixing device 19 including the reflective optical sensor 200. The color printer 100 (refer to FIG. 1A) according to the present embodiment can convey an A4-sized transfer sheet to the fixing device 19 in portrait or landscape orientation. In FIG. 2, the reference sign A4T indicates a sheet width when the A4-sized transfer sheet S is conveyed in portrait orientation, whereas the reference sign A4L indicates a sheet width when the A4-sized transfer sheet S is conveyed in landscape orientation.

The size of the width direction (X-axial direction) of the fixing belt 61 is set at substantially equal to the sheet width A4L. Accordingly, when the A4-sized transfer sheet S is conveyed in landscape orientation, linear flaws occurring at the ends of the fixing belt 61 in the longitudinal direction almost do not practically matter. In contrast, the sheet width A4T is shorter than the widthwise size of the fixing belt 61, and when the A4-sized transfer sheet S is conveyed in portrait orientation, the problem of the above linear flaws and the like can occur.

When a plurality of A4-sized transfer sheets S are conveyed in portrait orientation, it is substantially impossible to perfectly align the positions of the transfer sheets S with respect to the direction parallel to the width direction of the fixing belt 61. For this reason, the positions of the both side ends of the transfer sheets S on the fixing belt 61 slightly vary in the width direction of the fixing belt 61. What is called belt deviation can occur in the fixing belt 61 itself, and the positions of the both side ends of the transfer sheets S on the fixing belt 61 slightly vary also in this case. When the variation width of the position at which the transfer sheets S and the fixing belt 61 come into contact with each other is narrow, linear flaws also occur concentratedly in a narrow range. In view of this, when conveying a plurality of transfer sheets S, the position with respect to the fixing belt 61 may be intentionally deviated for each transfer sheet S.

Thus, the fixing belt 61 and the widthwise both ends of the portrait transfer sheet S come into contact with each other within ranges W1 and W2 (hereinafter referred to as contact ranges W1 and W2) having given widths with respect to the direction parallel to the width direction of the fixing belt 61. The size of the contact ranges W1 and W2 in the present embodiment is about 10 mm, for example. With such contact ranges W1 and W2 taken into consideration, when the A4-sized transfer sheet S is conveyed in portrait orientation, for the detection of the surface condition (the presence or absence of linear flaws and the position of linear flaws) on the fixing belt 61, a detection region A is required to be set larger than the widthwise size of the contact ranges W1 and W2.

In view of the above, the detection region A for the surface information of the fixing belt 61 by the reflective optical sensor 200 in the fixing device 19 is set wider than the contact range W2 among the contact ranges W1 and W2. In the present embodiment, considering that the width of flaws is about several hundred micrometers to several millimeters, and that the variation range of the position of flaws is about 10 mm, the size of the detection region A is preferably about 15 mm. In the present embodiment, the detection region A (that is, the reflective optical sensor 200) is not provided in a position corresponding to the contact range W1. This is because it is considered that linear flaws occurring on the fixing belt 61 would occur similarly for the contact range W1 and the contact range W2 and because it is considered that it is practically sufficient to determine the surface information of the fixing belt 61 only for one contact range. The detection region A may be set for each of the contact ranges W1 and W2, and the size of the detection region A may be set so as to cover the entire width of the fixing belt 61.

The reflective optical sensor 200 applies a plurality of beams of detection light at given intervals in a direction parallel to the width direction of the fixing belt 61 (X-axial direction). The region illuminated by these beams of detection light forms the detection region A. The reflective optical sensor 200 can form a long detection region A, and the relative position (the installation position of the reflective optical sensor 200) between the reflective optical sensor 200 and the widthwise ends of the transfer sheet S may be relatively approximate.

The surface information detector 300 receives the detection signal from the reflective optical sensor 200 and quantifies the position of linear flaws formed by the widthwise ends of the transfer sheet S and a flaw level as the surface information of the fixing belt 61 (procedures for the quantification will be described below). The flaw level refers to the degree of a flaw, that is, the depth of the flaw (a difference in surface roughness between a flaw part and a flaw-free part) and the width (size) of the flaw.

Next, an example of the constitution of the reflective optical sensor 200 (reflective optical detector) will be described with reference to FIG. 3A to FIG. 3D.

As can be seen from FIG. 3A to FIG. 3D, the reflective optical sensor 200 includes a substrate 201, side plates 202, 203, side plates 205, 206 (which are not illustrated in FIG. 3A, and refer to FIG. 3B), and a lens element 204.

Figure 3A:
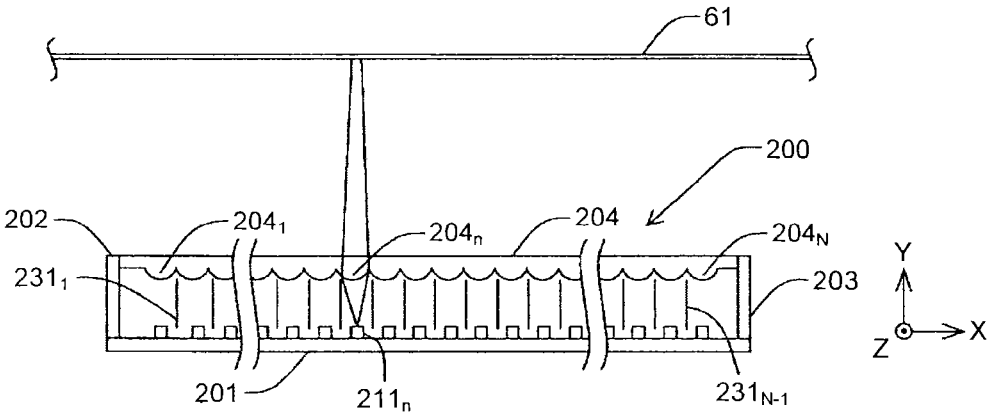
FIG. 3A is a sectional view illustrating the constitution of the illumination side of a reflective optical sensor.
Figure 3B:
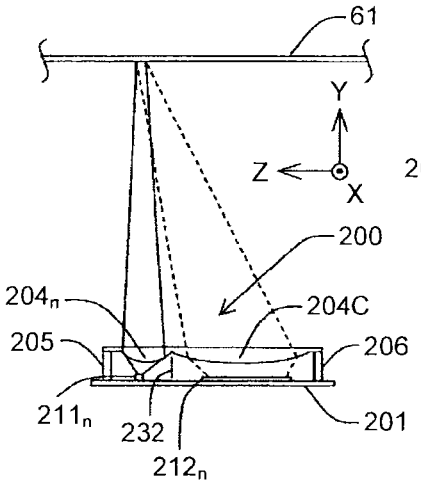
FIG. 3B is a diagram illustrating the arrangement of a lens element, a light emitting diode (an LED), and a photodiode (a PD) included in the reflective optical sensor.
Figure 3C:
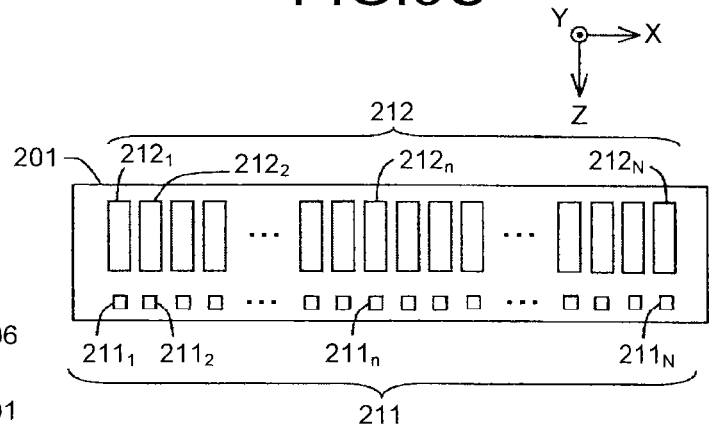
FIG. 3C is a plane view of a substrate included in the reflective optical sensor.

As illustrated in FIG. 3C, on the substrate 201, a plurality of light-emitting diodes (LEDs) 211 and a plurality of photodiodes 212 (hereinafter, denoted as "PDs 212") are arranged at given intervals in the X-axial direction. The arrangement number of the LEDs 211 is determined by design conditions and can be generally set at several tens to several hundreds. The number of the PDs 212 is the same as the number of the LEDs 211, and the arrangement pitch thereof is also the same as the arrangement pitch of the LEDs 211.

In the following, the respective LEDs 211 are numbered sequentially one by one from the left with respect to the paper plane for the convenience of description, and the nth one counted from the left with respect to the paper plane is represented by an LED $\mathbf{211}_n$. With the total number of the LEDs 211 being N, all the LEDs 211 are sequential arrangement of the LED $\mathbf{211}_1$, $\mathbf{211}_2$, . . . , $\mathbf{211}_n$, . . . , and $\mathbf{211}_N$. Similarly, the PDs 212 are also numbered sequentially one by one from the left with respect to the paper plane in FIG. 3C, and the nth one counted from the left with respect to the paper plane is represented by a PD $\mathbf{212}_n$. The total number of the PDs 212 is N, and all the PDs 212 are sequential arrangement of $\mathbf{212}_1$, $\mathbf{212}_2$, . . . , $\mathbf{212}_n$, . . . , and $\mathbf{212}_N$.

The LEDs $\mathbf{211}_n$ (n=1 to N) and the PDs $\mathbf{212}_n$ (n=1 to N) correspond to each other on a one-to-one basis. As illustrated in FIG. 3C, the LEDs $\mathbf{211}_n$ and the PDs $\mathbf{212}_n$ that correspond to each other are arranged at the same positions in the X-axial direction.

Figure 3D:
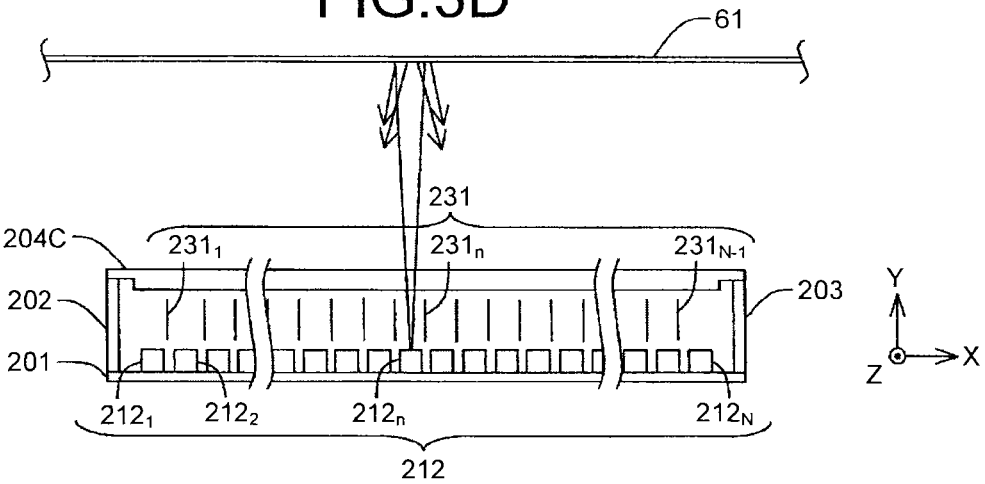
FIG. 3D is a sectional view illustrating the constitution of the light-receiving side of the reflective optical sensor.
Figure 4:
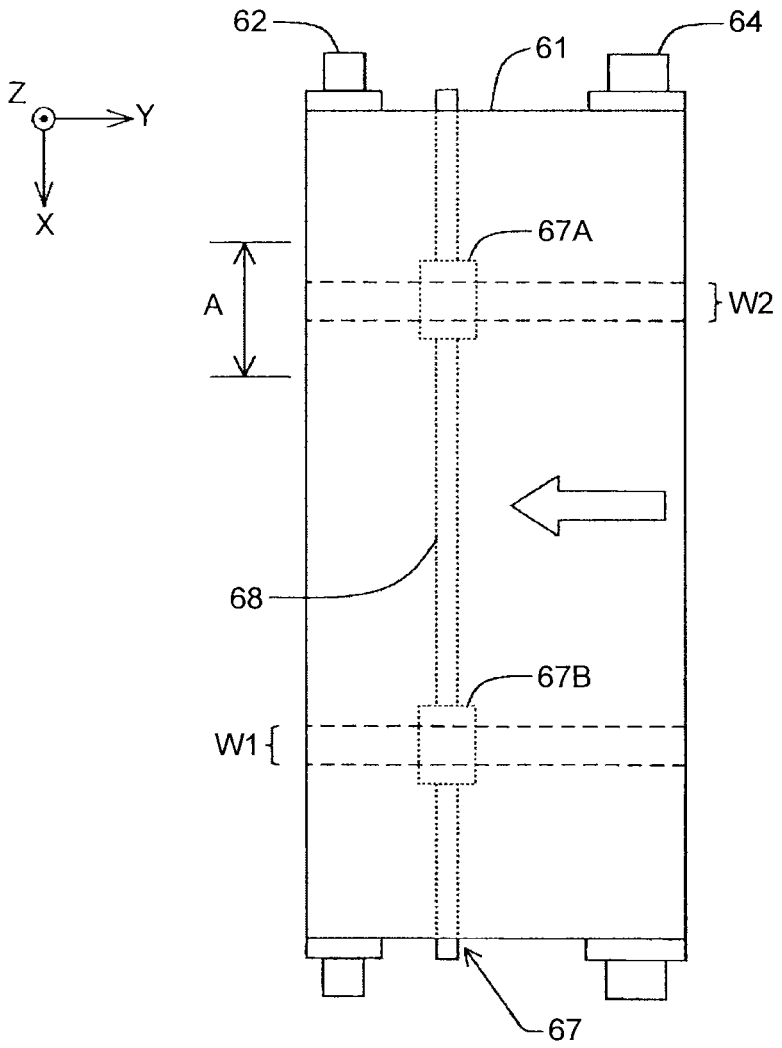
FIG. 4 is a diagram illustrating the arrangement of a surface condition changing roller.

The lens element 204 includes two area parts including an area of an irradiation lens array in which irradiation lenses $\mathbf{204}_n$ (n=1 to N) are arranged in an array illustrated in FIG. 3A and an area of a light-receiving lens 204C illustrated in FIG. 3D.

The number of the irradiation lenses $\mathbf{204}_n$ is the same as the number (N) of the LEDs 211, and the irradiation lenses $\mathbf{204}_n$ are arranged on the +Y side of the LEDs 211 at given intervals in the X-axial direction so that the respective LEDs $\mathbf{211}_n$ and irradiation lenses $\mathbf{204}_n$ correspond to each other on a one-to-one basis. The light-receiving lens 204C is, as illustrated in FIG. 3D, a single cylindrical lens having positive power only in the Z-axial direction and is arranged on the +Y side of the PDs $\mathbf{212}_1$ to $\mathbf{212}_N$. The part of the irradiation lens array in which the irradiation lenses $\mathbf{204}_n$ (n=1 to N) are formed and the part in which the light-receiving lens 204C is formed can be integrated by resin molding using a synthetic resin material, for example.

As illustrated in FIG. 3A and FIG. 3D, the reflective optical sensor 200 includes light-shielding walls $\mathbf{231}_n$ (n=1 to N−1) for preventing a flare among pairs that are adjacent to the pair of the LEDs $\mathbf{211}_n$ and the irradiation lenses $\mathbf{204}_n$. As illustrated in FIG. 3B, the reflective optical sensor 200 includes a light-shielding wall 232 for preventing a flare between the arrangement of the LEDs $\mathbf{211}_n$ and the arrangement of the PDs $\mathbf{212}_n$.

The side plates 202, 203 (refer to FIG. 3A), 205 and 206 (refer to FIG. 3B) integrally form a case of the reflective optical sensor 200. The case (the side plates, 202, 203, 205 and 206), the light-shielding walls $\mathbf{231}_n$ (refer to FIG. 3A) and 232 (refer to FIG. 3B), and the lens element 204 can be integrated by resin molding using a synthetic resin material, for example.

In the reflective optical sensor 200, as illustrated in FIG. 3A, when the LED $\mathbf{211}_n$ is turned on, an emitted divergent light flux is collected by the irradiation lens $\mathbf{204}_n$ corresponding to the LED $\mathbf{211}_n$ and irradiates the surface of the fixing belt 61. As illustrated in FIG. 3B, reflected light from the part (referred to as an optical spot) irradiated by the light flux from the LED $\mathbf{211}_n$ on the surface of the fixing belt 61 is collected by the light-receiving lens 204C only in the Z-axial direction and enters the PD $\mathbf{212}_n$.

Returning back to FIG. 1C, the fixing device 19 includes a surface condition changing controller 400 that controls the operation of the surface condition changing roller 67. The surface condition changing controller 400 is arranged within the color printer 100 (refer to FIG. 1A). The surface condition changing controller 400 is connected to the surface condition changing roller 67 and receives a detection result obtained by the surface information detector 300 (the detection signal from the reflective optical sensor 200), thereby controlling the operation of the surface condition changing roller 67. This control will be described later.

The surface condition changing roller 67 comes into contact with and separates from the fixing belt 61 and rubs thereagainst by a drive unit not illustrated in FIG. 1C. The drive unit not illustrated and the surface condition changing roller 67 constitute a surface condition changing device, and the drive unit is controlled by the surface condition changing controller 400.

The surface condition changing roller 67 changes the surface condition of a part in which a linear flaw occurs of the fixing belt 61, and it is obvious that the surface condition changing roller 67 is required to be arranged so as to achieve this object. In the present embodiment, as illustrates in FIG. 4, a pair of surface condition changing rollers 67A and 67B is arranged at positions corresponding to the contact ranges W1 and W2. The surface condition changing rollers 67A and 67B are both arranged on a rotating shaft 68, and one comes into contact with and separates from a region including the contact range W1, whereas the other comes into contact with and separates from a region including the contact range W2. Both the surface condition changing rollers 67A and 67B are set so that the lengths in the direction of the rotating shaft 68 are slightly shorter than the detection region A and are slightly longer than the contact ranges W1 and W2. In the present embodiment, the reflective optical sensor 200 (not illustrated in FIG. 4, and refer to FIG. 2) is movable in the width direction of the fixing belt 61 in accordance with the widthwise size of the transfer sheet (thereby changing the position of the detection region A), and the surface condition changing rollers 67A and 67B are also movable along the rotating shaft 68.

The parts that perform the control of the reflective optical sensor 200 and the surface condition changing roller 67 in the surface information detector 300 and the surface condition changing controller 400, respectively, can be constituted as a microcomputer or a CPU. The part that performs the above control can be incorporated into the same computer as control programs.

Figure 5:
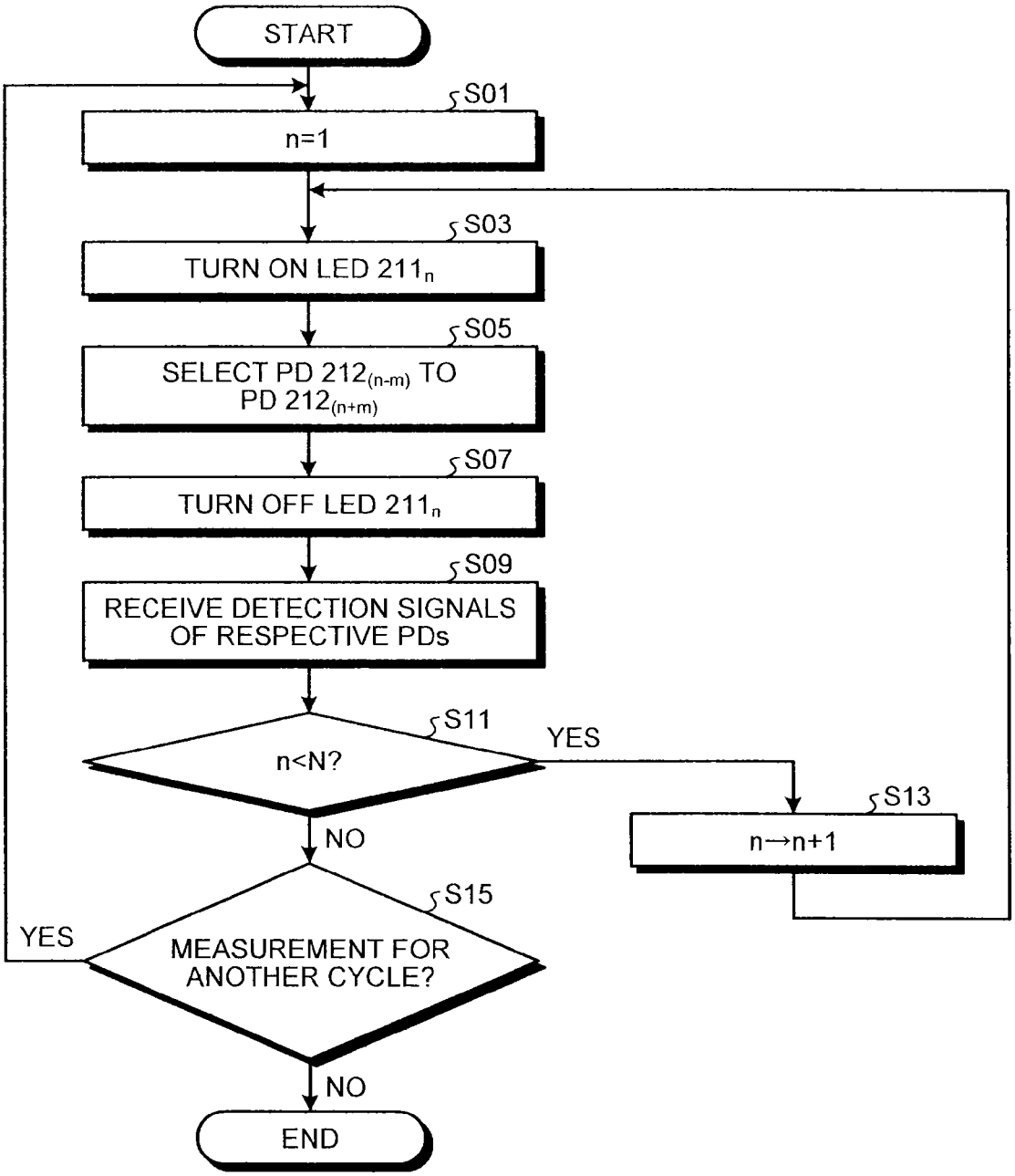
FIG. 5 is a flow diagram illustrating the operation of the reflective optical sensor.

Described next with reference to the flow diagram illustrated in FIG. 5 is operation for detecting the surface condition of the fixing belt 61 by the surface information detector 300 using the reflective optical sensor 200.

In the present embodiment, the surface information detector 300 performs what is called sequential lighting that repeatedly turns on and off the LED $\mathbf{211}_1$ to the LED $\mathbf{211}_N$ illustrated in FIG. 3A sequentially one by one. Thus, the surface information detector 300 sets n=1 at Step S01, the LED $\mathbf{211}_n$ (the LED $\mathbf{211}_1$ in this example) is turned on at Step S03, and the process proceeds to Step S05.

At Step S05, the surface information detector 300 selects the PD 212 that receives the reflected light from the fixing belt 61 in synchronization with the turning on of the nth LED $\mathbf{211}_n$. The reflection from the fixing belt 61 is not mirror reflection but diffuses also in the X-axial direction, and the reflected light when the LED $\mathbf{211}_n$ is turned on is received by the PD $\mathbf{212}_n$ corresponding thereto and another PD 212 adjacent to the PD $\mathbf{212}_n$. In the present embodiment, for the sake of simplicity, the number of the light-receiving PDs 212 is assumed to be an odd number and assumed to be (2m+1) with m as an integer. In other words, the reflected light when the LED $\mathbf{211}_n$ is turned on is received by the PD $\mathbf{212}_n$ corresponding thereto and (2m+1) of PDs arranged on both sides thereof. When m=2, for example, the PDs that receive the reflected light are five PDs including the PD $\mathbf{212}_{n-2}$, the PD $\mathbf{212}_{n-1}$, the PD $\mathbf{212}_n$ (that corresponds to the LED $\mathbf{211}_n$), the PD $\mathbf{212}_{n+1}$, and the PD $\mathbf{212}_{n+2}$. However, when n=1, and when the LED $\mathbf{211}_1$ is turned on, the light-receiving PDs are not five but three PDs including the PD $\mathbf{212}_1$, the PD $\mathbf{212}_2$, and the PD $\mathbf{212}_3$, even when m=2. Also when the light-receiving PDs are not five but three PDs including the PD $\mathbf{212}_{N-2}$, the PD $\mathbf{212}_{N-1}$, and the PD $\mathbf{212}_N$.

After the elapse of a sufficient time to receive the reflected light from the fixing belt 61, the surface information detector 300 turns off the LED $\mathbf{211}_n$ at Step S07 (the LED $\mathbf{211}_1$ in this example). After performing the turning on and off of the LED 211, the PDs 212 that have received the reflected light photo-electrically convert the amount of light received. The photoelectrically converted signal is amplified to be a detection signal. The respective detection signals of the PDs 212 are sent to the surface information detector 300 every detection, and the surface information detector 300 receives them at Step S09, and the process proceeds to Step S11.

At Step S11, the surface information detector 300 determines whether the sequential lighting of the LEDs 211 has ended. Specifically, if n<N, the surface information detector 300 determines that the detection signals from all the PDs $\mathbf{212}_1$ to $\mathbf{212}_n$ have not been received, performs the processing at Step S13 to increment n, and then performs the processing at Step S03. After that, the sequential lighting is repeated for all the LEDs, and at n=N, when the LED $\mathbf{211}_N$ is turned on and off, this is regarded as one cycle to end the sequential lighting. If n=N, at Step S11, the surface information detector 300 performs the processing at Step S15.

In the present embodiment, in order to increase the detection accuracy of the PDs $\mathbf{212}_1$ to $\mathbf{212}_N$, the above sequential lighting (Step S1 to Step S13) of the LEDs 211 may be performed over a plurality of cycles to perform averaging processing on the detection results for the cycles. At Step S15, the surface information detector 300 determines whether the above sequential lighting of the LEDs $\mathbf{211}_1$ to $\mathbf{211}_N$ is repeatedly performed. If the sequential lighting is performed, the process returns to Step S01 and the subsequent processing is repeated. If the sequential lighting is not performed, the processing ends. For the LEDs 211 to be turned on and off, not all of the N LEDs are required to be used, and N' (≤N) LEDs out of them can be used. For the LEDs to be sequentially turned on, for example, not N LEDs $\mathbf{211}_1$ to $\mathbf{211}_N$, but a total of N−4 LEDs excluding two LEDs each at both ends, including the LED $\mathbf{211}_3$ to LED $\mathbf{211}_{N-2}$ may be sequentially turned on.

Figure 6:
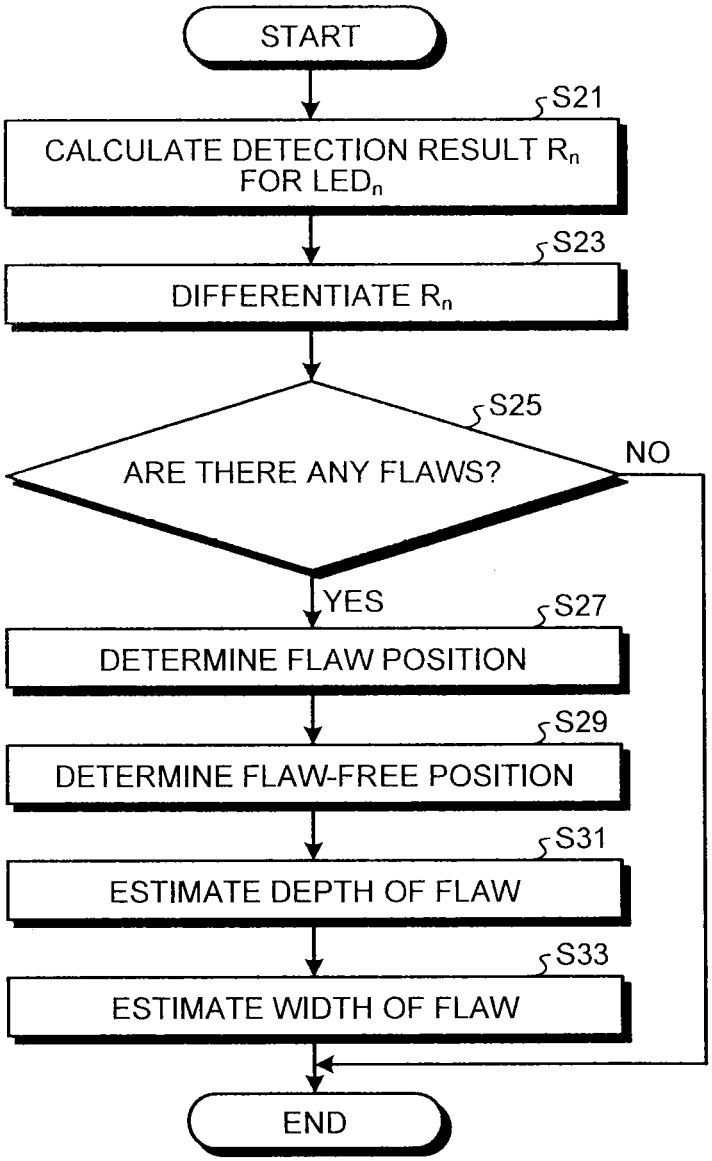
FIG. 6 is a flow diagram explaining surface information detection operation in a surface information detector.

Upon the detection signal from the PD 212 being sent to the surface information detector 300, the surface information detector 300 determines the surface information of the fixing belt 61 as illustrated in FIG. 6 based on the detection signal.

Upon receiving the detection signals of the respective PDs ($\mathbf{212}_1$ to $\mathbf{212}_N$) (the number of the detection signals is in principle (2m+1) each time one LED is turned on and off), the surface information detector 300 calculates the sum of the (2m+1) detection signals each time the detection signal is received at Step S21 to be regarded as a detection result $R_n$ (n=1 to N). Thus, the surface information detector 300 can obtain the detection result $R_n$ for a plurality of points (optical spots) on the fixing belt 61 corresponding to the LEDs 211 arranged at the given intervals in the width direction of the fixing belt 61 (the process proceeds to Step S23).

At Step S23 and the subsequent steps, the surface information detector 300 detects the surface information of the fixing belt 61 based on the detection result $R_n$ determined at Step S21. In the following, the detection result $R_n$ will be referred to as reflective light intensity $R_n$.

Generally, when there is a flaw on the surface of the fixing belt 61, the reflected light from the fixing belt 61 decreases in a regular reflection component and increases in a diffused reflection component compared with a case when there is no flaw. With regard to the above example, when the LED $\mathbf{211}_n$ is turned on, if there is a flaw on the reflection position (optical spot), the regular reflection component decreases in this part, thereby decreasing the amount of light received by the PD $\mathbf{212}_n$ compared with the case when there is no flaw and increasing the amount of light received by the surrounding PD $\mathbf{212}_{n-m}$ to the PD $\mathbf{212}_{n-1}$ and the PD $\mathbf{212}_{n+1}$ to the PD $\mathbf{212}_{n+m}$ compared with the case when there is no flaw. However, collectively, the value of the detection result $R_n$ corresponding to a part on which a flaw is present reduces compared with that of a part that is free from flaw. Based on such characteristics of the detection signal, the surface information detector 300 quantifies the presence or absence of flaws, the flaw level, and the position of the flaw as the surface information.

For this purpose, the surface information detector 300 differentiates the thus obtained detection result $R_n$ at Step 23, and the process proceeds to Step S25. The differentiating operation may be performed in various ways, and described in this example is, as the easiest operation, dividing the difference $(R_{n+1})-(R_n)$ between adjacent detection results $R_n$ and $R_{n+1}$ by an arrangement pitch P of the PDs 212. In other words, this is an operation that calculates the slope of the adjacent detection results.

Figure 7A:
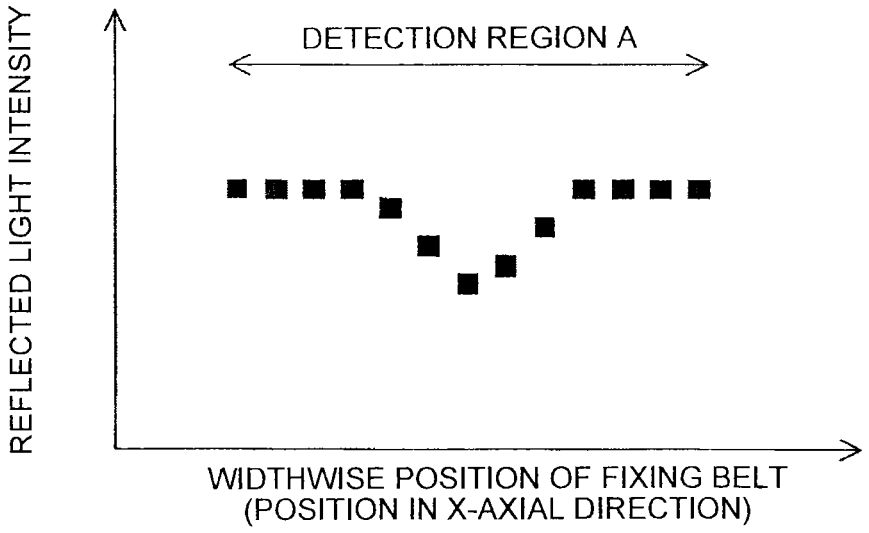
FIG. 7A and FIG. 7B are diagrams illustrating the relation of the widthwise position of a fixing belt to reflected light intensity and its differentiated value, respectively.

At Step S25, the surface information detector 300 determines the presence or absence of flaws on the surface of the fixing belt. The following describes a method for determining the presence or absence of flaws with reference to FIG. 7A. FIG. 7A illustrates an example of the detection result $R_n$ (the vertical axis is "reflected light intensity") obtained by one cycle of sequential lighting of the LEDs 211. For the simplicity of illustration, FIG. 7A illustrates fewer data points than the actual ones. The detection result $R_n$ (reflected light intensity) is obtained in association with a plurality of positions that are spaced apart from each other in the width direction (X-axial direction) of the fixing belt 61 in the detection region A (refer to FIG. 2), and thus a comparison on the reflected light intensity between adjacent beams of reflected light intensity in FIG. 7A indicates that there is a flaw at a position where the reflected light intensity reduces. In FIG. 7A, the value of the detection result $R_n$ (reflected light intensity) reduces near the center of the detection region A, and this fact indicates that there is a flaw on the surface of the fixing belt 61. Thus, the presence of the flaw is detected as the surface information. Returning back to FIG. 6, if any flaw is detected on the surface of the fixing belt 61, and the process proceeds to Step S27. If no flaw is detected, the processing ends.

Figure 7B:
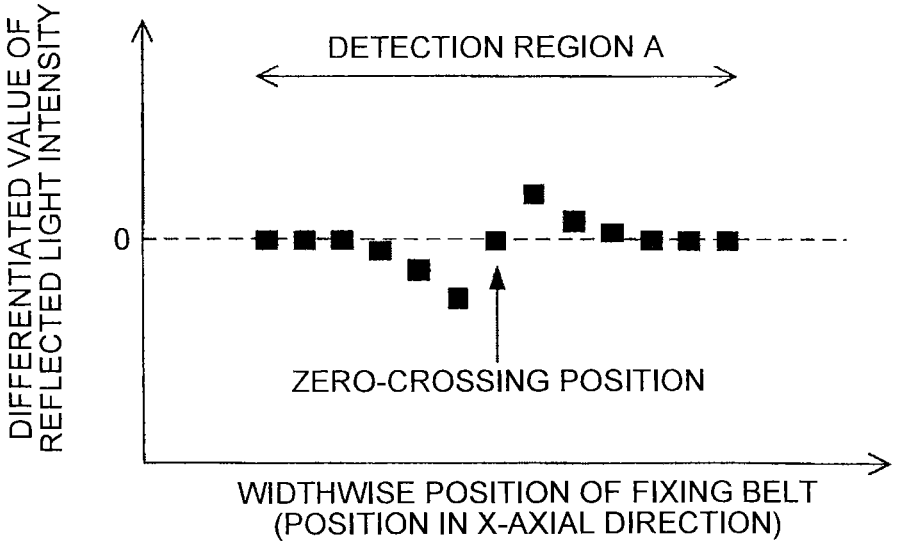

At Step S27, the surface information detector 300 determines the position of the flaw. The following describes a method for determining the position of the flaw with reference to FIG. 7B. FIG. 7B illustrates results obtained by performing the above differentiating operation (refer to Step S23) on the detection result $R_n$ (reflected light intensity) illustrated in FIG. 7A in a graph. As is evident from a general differentiation theory, a differentiated value is zero at the minimum value, and the differentiated value changes from negative to positive around the minimum value. In view of this, determining a zero-crossing position at which the differentiated value significantly changes from negative to positive in the graph illustrated in FIG. 7B can detect (determine) the position of the flaw. When the absolute value of the differentiated value is smaller than a preset value (a threshold), it is indicated that a decrease in the reflected light intensity is small enough to be negligible, and it is determined that no flaw is present.

Figure 8A:
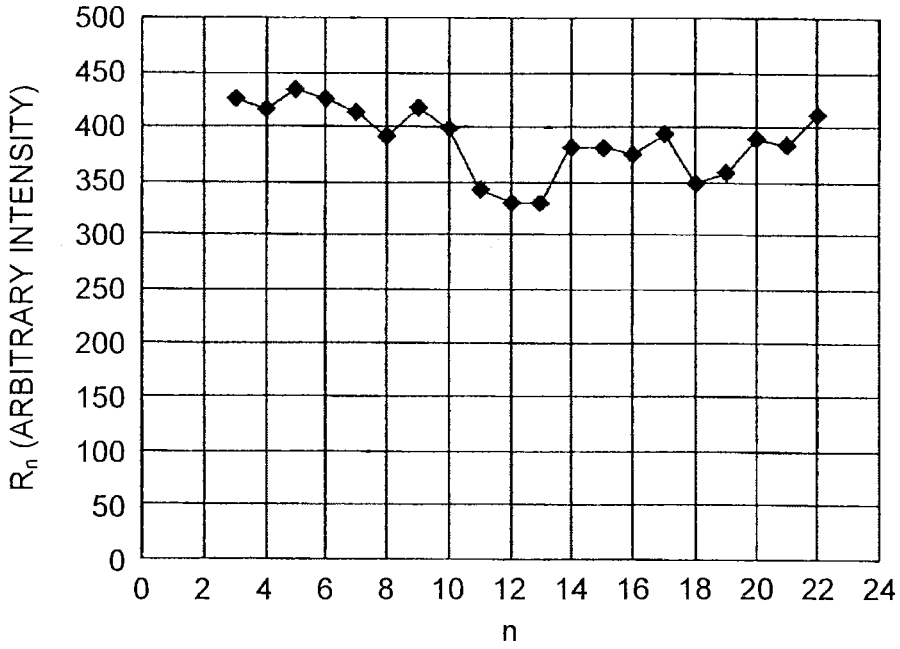
FIG. 8A and FIG. 8B are diagrams illustrating detection results obtained by the reflective optical sensor and their differentiated values, respectively, in an embodiment.

The following describes the method for determining the position of the flaw with reference to a specific example. The present specific example describes a case in which the reflective optical sensor 200 illustrated in FIG. 3A to FIG. 3D has the following constitution. Specifically, the reflective optical sensor 200 has the arrangement number of the LEDs 211 and the PDs 212: N=24, the LEDs to be sequentially lighted: n=3 to 22, and the arrangement pitch of the LEDs 211 and the PDs 212: P=1 mm. In the reflective optical sensor 200, optical spots are formed at a pitch of 1 mm on the surface of the fixing belt 61. For the fixing belt 61 after performing fixing on 400,000 transfer sheets (conveyance of A4 size in portrait orientation), FIG. 8A illustrates the relation between the detection result $R_n$ obtained by using the reflective optical sensor 200 and the widthwise position of the fixing belt 61. The optical spots are formed on the surface of the fixing belt at the arrangement pitch P=1 mm, and n on the horizontal axis of FIG. 8A is equivalent to the representation of the positions of the optical spots (the irradiation positions by the LEDs) in millimeters.

Figure 8B:
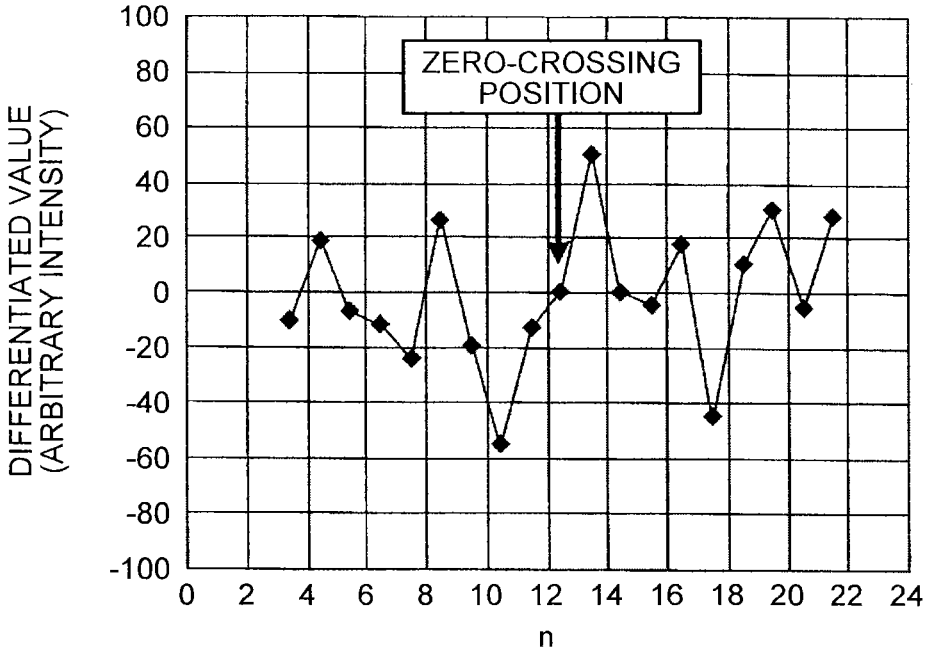

FIG. 8B illustrates a result of differentiating the detection result $R_n$ of FIG. 8A. In order to smooth the differentiated values, slopes at three points, $R_{n-1}$, $R_n$, and $R_{n+1}$, can also be calculated. The zero-crossing position of the graph illustrated in FIG. 8B is determined to give n=12.5, thereby enabling the position at 12.5 mm, which is the midpoint between the optical spot irradiation positions corresponding to the LED $\mathbf{211}_{12}$ and the LED $\mathbf{211}_{13}$, to be detected (determined) as the position of the flaw.

Figure 10A:
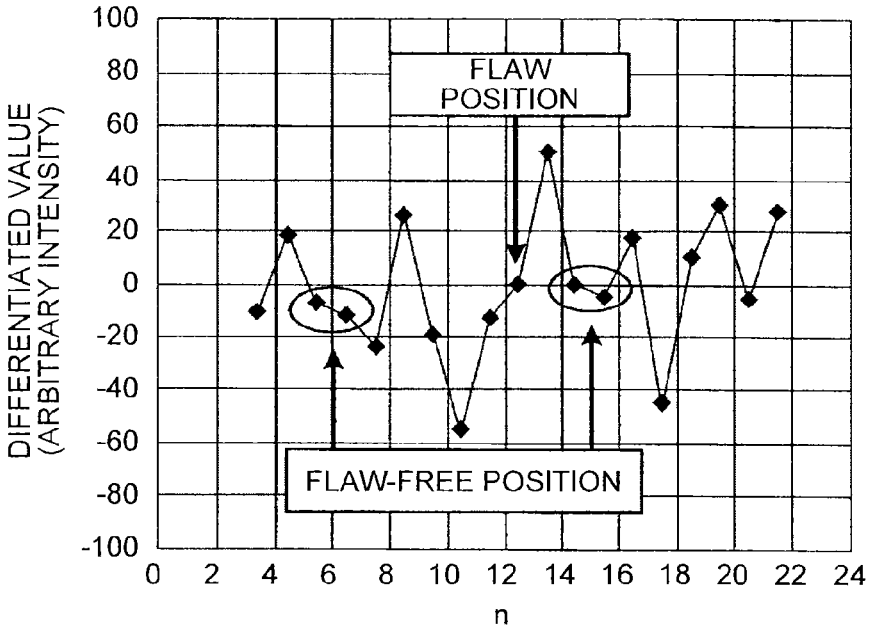
FIG. 10A is a diagram illustrating a method for determining the position of a flaw on the surface of the fixing belt from differentiated values of detection results obtained by the reflective optical sensor in the embodiment.

After the completion of the determination of the position of the flaw (Step S27), the surface information detector 300 determines a flaw-free position on the fixing belt 61 at Step S29. The flaw-free position is a position at which the variation of detection result $R_n$ is small, that is, a position at which the differentiated value of the detection result $R_n$ is close to zero. In the present embodiment, as illustrated in FIG. 10A, n=6 and n=15 can be selected as the flaw-free positions (the positions at which the differentiated values are close to zero) (the process proceeds to Step S31).

The surface information detector 300 performs flaw level detection (determination) operation at Steps S31 and S33. The flaw level includes the depth of the flaw (a difference in surface roughness between the flaw part and the flaw-free part) and the width of the flaw. The detection of the depth of the flaw is performed first at Step S31.

Figure 9:
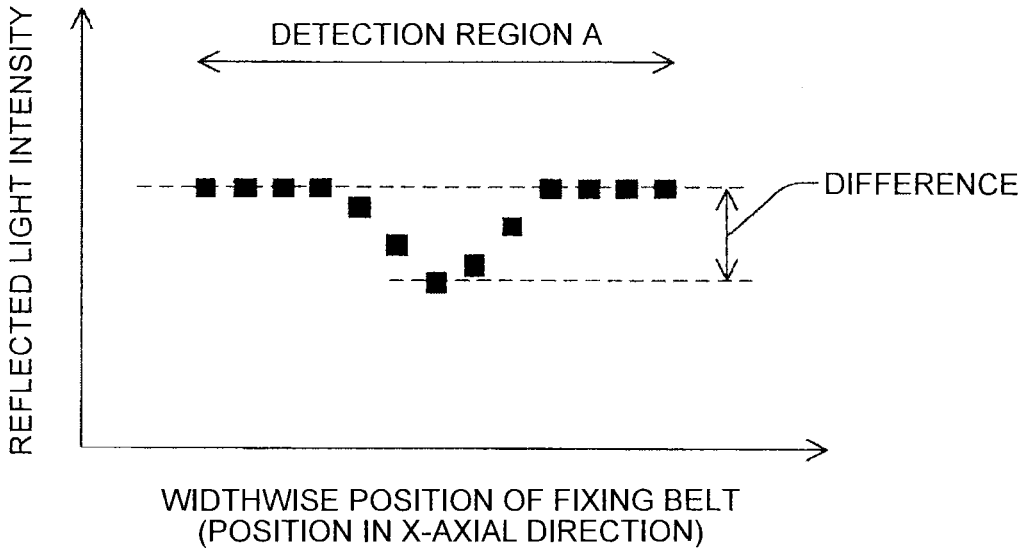
FIG. 9 is a diagram explaining an example of a method for determining the depth of a flaw on the surface of the fixing belt.

From a qualitative point of view, it is considered that a flaw having a larger depth gives larger roughness on the surface of the fixing belt 61 and a larger decrease in the reflected light intensity. In view of this, in order to detect the depth of the flaw, the amount of decrease in the reflected light intensity may be determined. When a change in the detection result $R_n$ (reflected light intensity) is as illustrated in FIG. 9, for example, the minimum value of the detection result $R_n$ may be simply determined to determine the minimum value to be the depth of the flaw. However, caused by the installation state (inclination) of the reflective optical sensor 200, the inclination of the fixing belt 61, or the like, the inclination component can be superimposed on the detection result $R_n$.

Figure 10B:
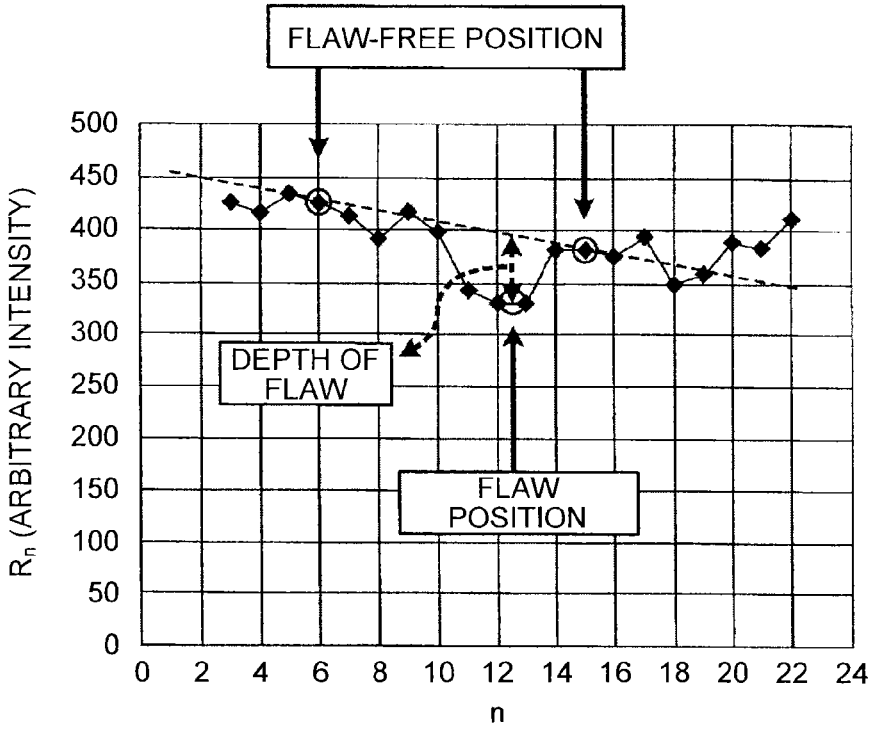
FIG. 10B is a diagram illustrating a method for determining the depth of a flaw on the surface of the fixing belt from detection results obtained by the reflective optical sensor in the embodiment.

In view of the above, the surface information detector 300 determines the depth of the flaw on the fixing belt 61 by subtracting the inclination component that can be superimposed on the detection result $R_n$. The following describes that method. First, the position of the flaw on the fixing belt 61 is detected at Step S27, and the flaw-free position on the fixing belt 61 is detected at Step S29. In order to subtract the inclination component, the distance between an approximate line connecting detection results at a plurality of flaw-free positions and the detection result at the flaw position may be determined as illustrated in FIG. 10B. The broken line in FIG. 10B is an approximate line connecting $R_{n1}$ (n=6 in this example) and $R_{n2}$ (n=15 in this example), whereas the broken arrow corresponds to the depth of the flaw. As can be seen in FIG. 10B, the difference in the detection result $R_n$ indicating the depth of the flaw in this example is 63.1. The rate of decrease in the reflected light intensity at the flaw position is 0.16 (16%).

The surface information detector 300 estimates the depth of the flaw on the fixing belt 61 at Step S31, and then performs the processing at Step S33 to estimate the width (size) of the flaw on the fixing belt 61. The following describes a method for estimating the width of the flaw.

Figure 11:
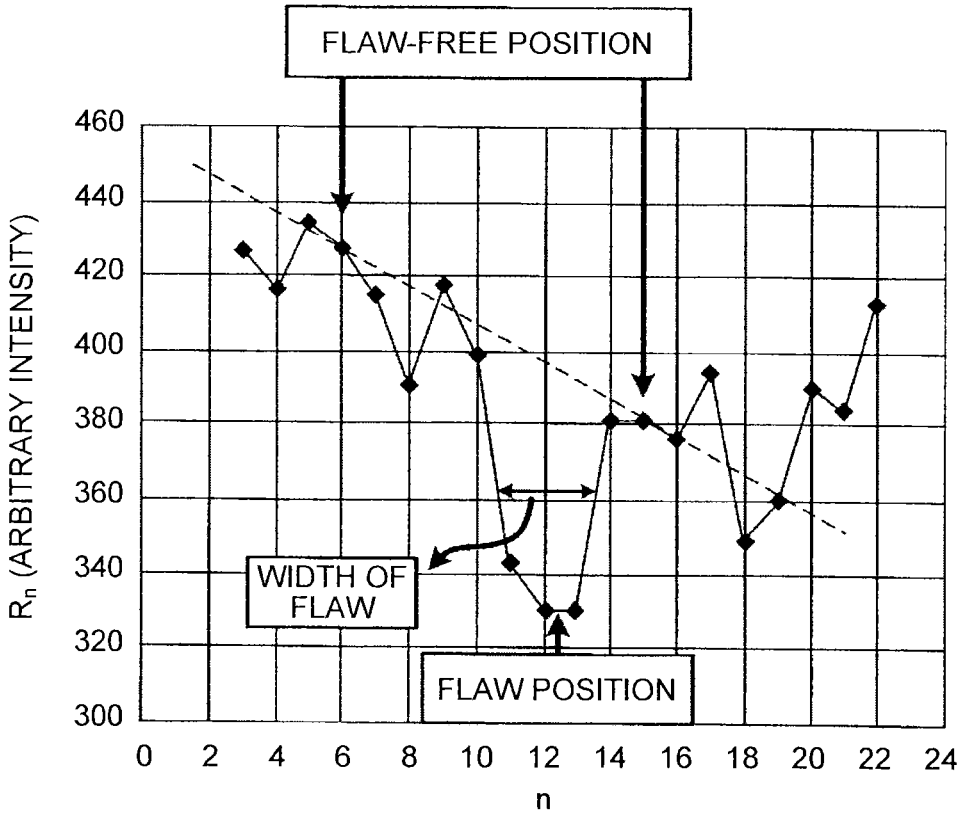
FIG. 11 is a diagram illustrating a method for determining the width of a flaw on the surface of the fixing belt from detection results obtained by the reflective optical sensor.

The central position of the flaw has been detected at Step S27. From the detection result $R_n$ at the flaw position, a position is calculated at which the reflected light intensity corresponding to the depth of the flaw (roughness) decreases by a given amount (50%, for example). FIG. 11 illustrates a diagram enlarging the vertical axis of FIG. 10B. From the result of FIG. 11, the width of the flaw can be estimated (determined) to be 3 mm (the end of processing).

Figure 12A:
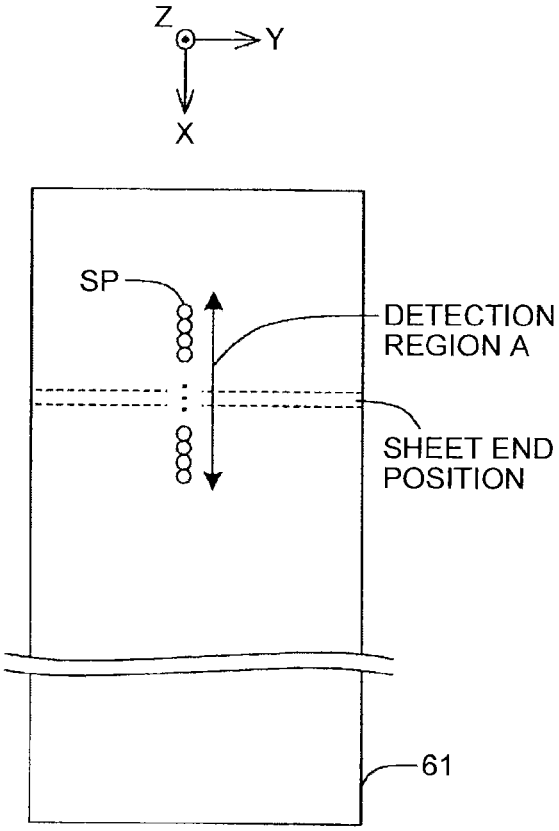
FIG. 12A and FIG. 12B are diagrams illustrating an example of the arrangement of optical spots illuminated by the reflective optical sensor and its modification, respectively.
Figure 12B:
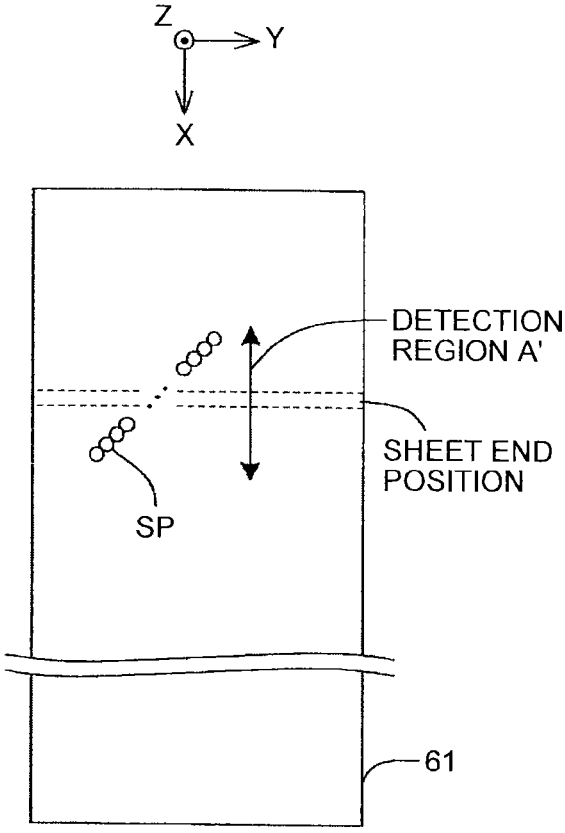

The surface information (the depth of the flaw, the width of the flaw, and the like) may be all detected, and only necessary piece of information may be determined. Although the present embodiment forms a plurality of optical spots SP (detection positions by the reflective optical sensor 200) in the direction parallel to the width direction (X axis direction) of the fixing belt 61 on the fixing belt 61 as illustrated in FIG. 12A. However, without being limited thereto, the optical spots SP may intersect the X axis at 45 degrees as illustrated in FIG. 12B, for example. Although the length of the detection region A' in the X-axial direction in this case is shorter than that of the detection region A (refer to FIG. 12A) by a proportion of $1/\sqrt{2}$, the arrangement pitch of the adjacent optical spots can also be reduced by the proportion of $1/\sqrt{2}$ compared with the case illustrated in FIG. 12A, thereby improving the position resolution of the detection result.

Described next is operation for changing the surface condition of the fixing belt 61 using the surface condition changing device (the surface condition changing roller 67).

Figure 13A:
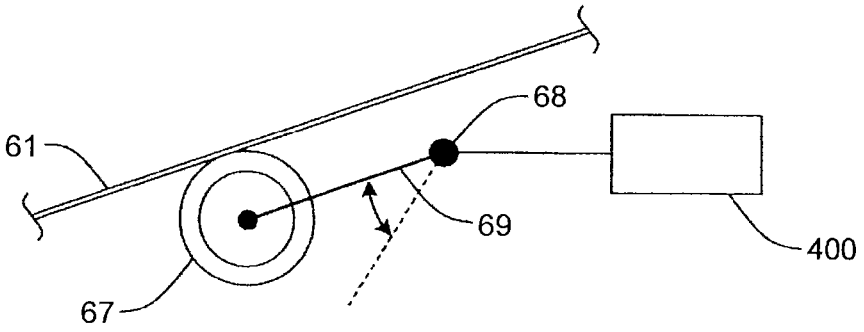
FIG. 13A and FIG. 13B are diagrams illustrating a state in which the surface condition changing roller is in contact with the surface of the fixing belt and a state in which the surface condition changing roller is separate from the surface of the fixing belt, respectively.
Figure 13B:
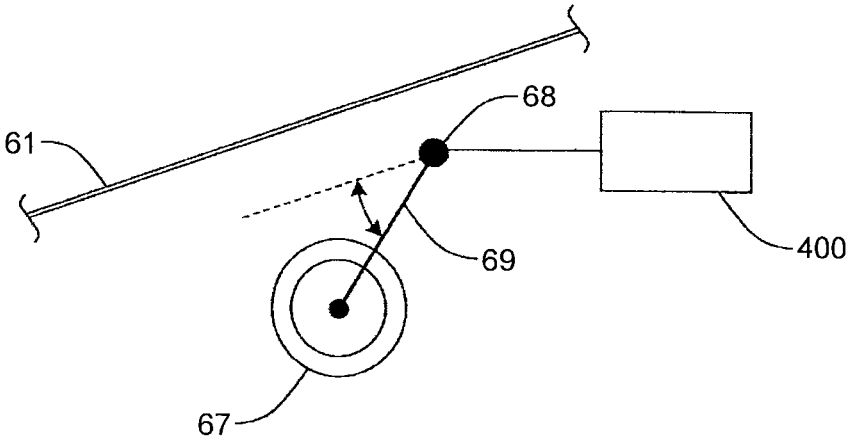

As schematically illustrated in FIG. 13A and FIG. 13B, the surface condition changing roller 67 is supported on a rod 69. The rod 69 is connected to the rotating shaft 68, and the rod 69 and the rotating shaft 68 are controlled to be driven by the surface condition changing controller 400. FIG. 13A illustrates a state in which the surface condition changing roller 67 is in contact with the surface of the fixing belt 61, whereas FIG. 13B illustrates a state in which the surface condition changing roller 67 is separate from the fixing belt 61. Thus, the surface condition changing roller 67 can come into contact with and separate from the fixing belt 61. Changing the surface condition of the fixing belt 61 is performed according to the procedure in the chart illustrated in FIG. 14.

Figure 14:
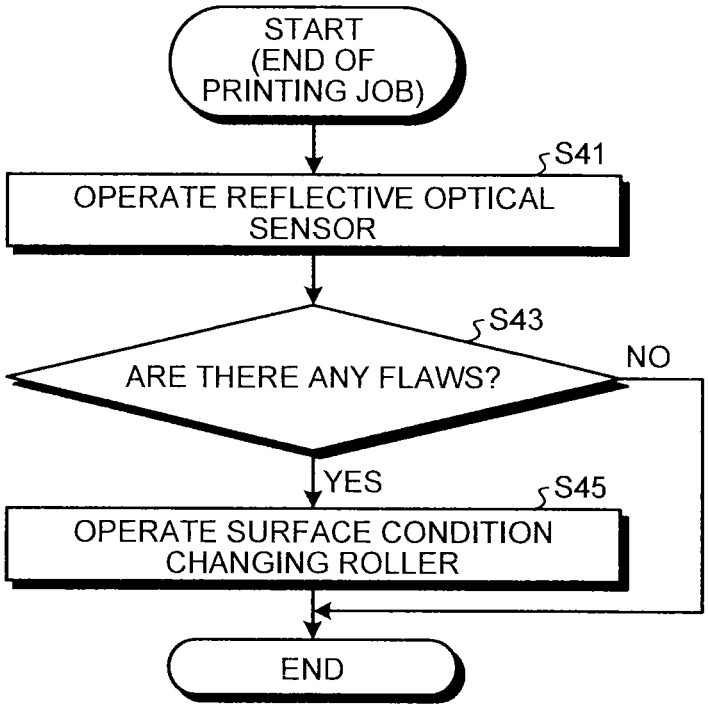
FIG. 14 is a diagram explaining operation for changing the surface condition of the fixing belt.

As illustrated in FIG. 14, when a printing job ends (an image forming process ends), the reflective optical sensor 200 operates in accordance with the flow diagram of FIG. 5 with the fixing belt 61 rotatingly driven at Step S41. When the operation of the reflective optical sensor 200 ends, the surface information detector 300 performs the processing at Step S43 to detect (determine) the surface condition of the fixing belt 61. As a result of this determination, if there is no flaw (No at Step S43), the processing ends without driving the surface condition changing roller 67. In contrast, if the surface information detector 300 detects the presence of a flaw on the fixing belt 61 (Yes at Step S43), the process proceeds to Step S45, and the surface condition changing controller 400 receives the detection result from the surface information detector 300 and controls the operation of the surface condition changing roller 67 as follows.

Figure 15:
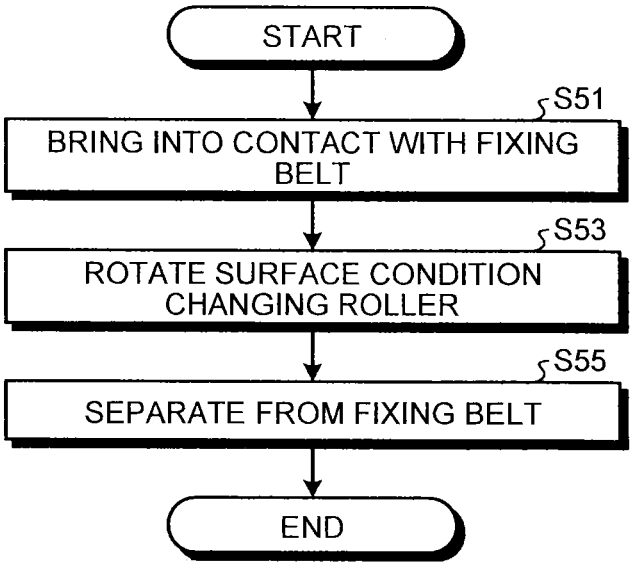
FIG. 15 is a diagram explaining the operation of the surface condition changing roller.

FIG. 15 is a diagram illustrating the operation of the surface condition changing roller 67. The surface condition changing roller 67 retracts to a position spaced apart from the fixing belt 61 during a normal period (during the printing job, for example), and the surface condition changing controller 400, after starting its operation, first rotatingly drives the surface condition changing roller 67 at Step S51, then brings the surface condition changing roller 67 into contact with the fixing belt 61, and the process proceeds to Step S53. During this process, the fixing belt 61 is maintained at a rotatingly driven state at all times. A rotating time that is appropriate for the flaw level is set in advance for the surface condition changing roller 67. The surface condition changing controller 400 rotatingly drives the surface condition changing roller 67 for a given time appropriate for the flaw level detected by the surface information detector 300 at Step S53.

This causes the surface layer having given roughness of the surface condition changing roller 67 to rotate in contact with the surface of the fixing belt 61, thereby abrading the part of the linear flaw formed by the sheet widthwise ends of the transfer sheet on the surface of the fixing belt 61 and exposing a new surface part on the fixing belt 61. In other words, the surface condition of the fixing belt 61 is changed. The degree of the change depends on the rotation time of the surface condition changing roller 67.

After rotating the surface condition changing roller 67 for the given time, the surface condition changing controller 400 performs the processing at Step S55 to separate the surface condition changing roller 67 from the fixing belt 61 and to stop its rotation. The surface condition changing roller 67 is retracted to its original position, and the operation of the surface condition changing roller 67 ends.

Figure 16A:
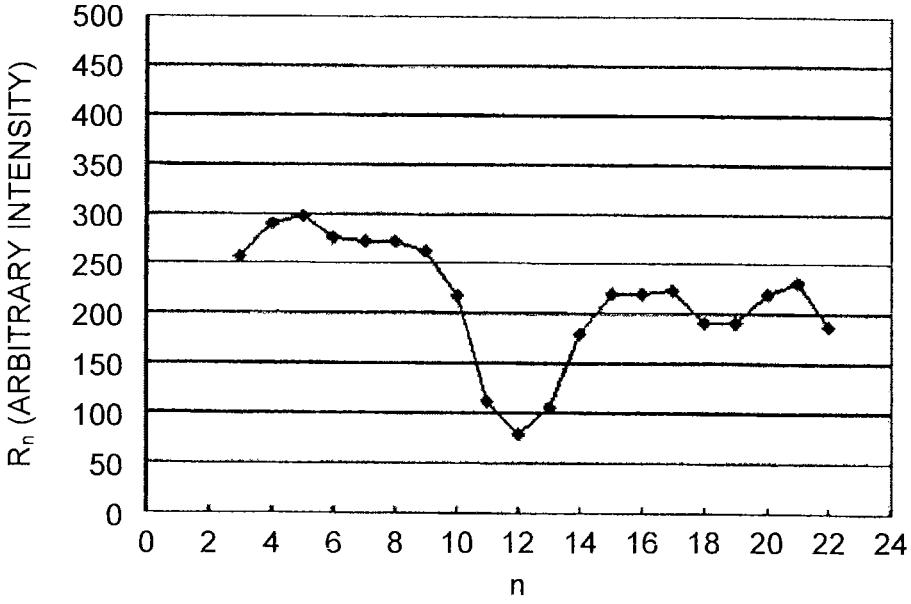
FIG. 16A and FIG. 16B are diagrams illustrating changes in reflected light intensity before removing a flaw and after removing the flaw, respectively, on the surface of the fixing belt.
Figure 16B:
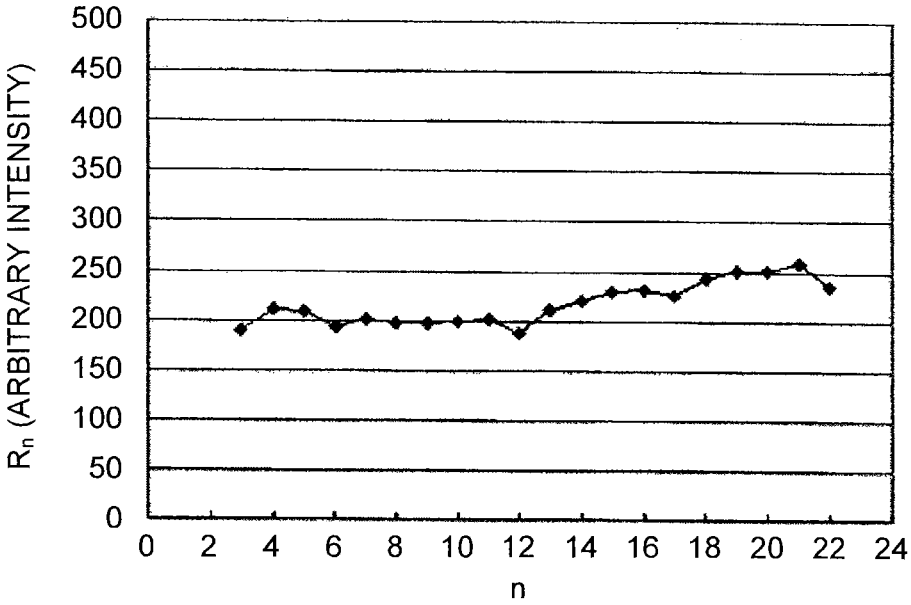

FIG. 16A illustrates an example of a detection result when, after the end of the printing job (the end of the image forming process), the surface condition of the fixing belt 61 was detected (determined), and it is determined that a flaw was present. FIG. 16B illustrates a detection result when, receiving the detection result illustrated in FIG. 16A, the surface condition changing roller 67 was brought into contact with the fixing belt 61 and was rotatingly driven for a given time, the surface condition changing roller 67 was separated from the fixing belt 61, the surface condition was detected (determined) again, and it was determined to be flaw-free as a result of the determination. FIG. 16A and FIG. 16B reveal that the linear flaw on the surface of the fixing belt 61 was abraded by the surface condition changing roller 67 to expose a new surface part.

Figure 17:
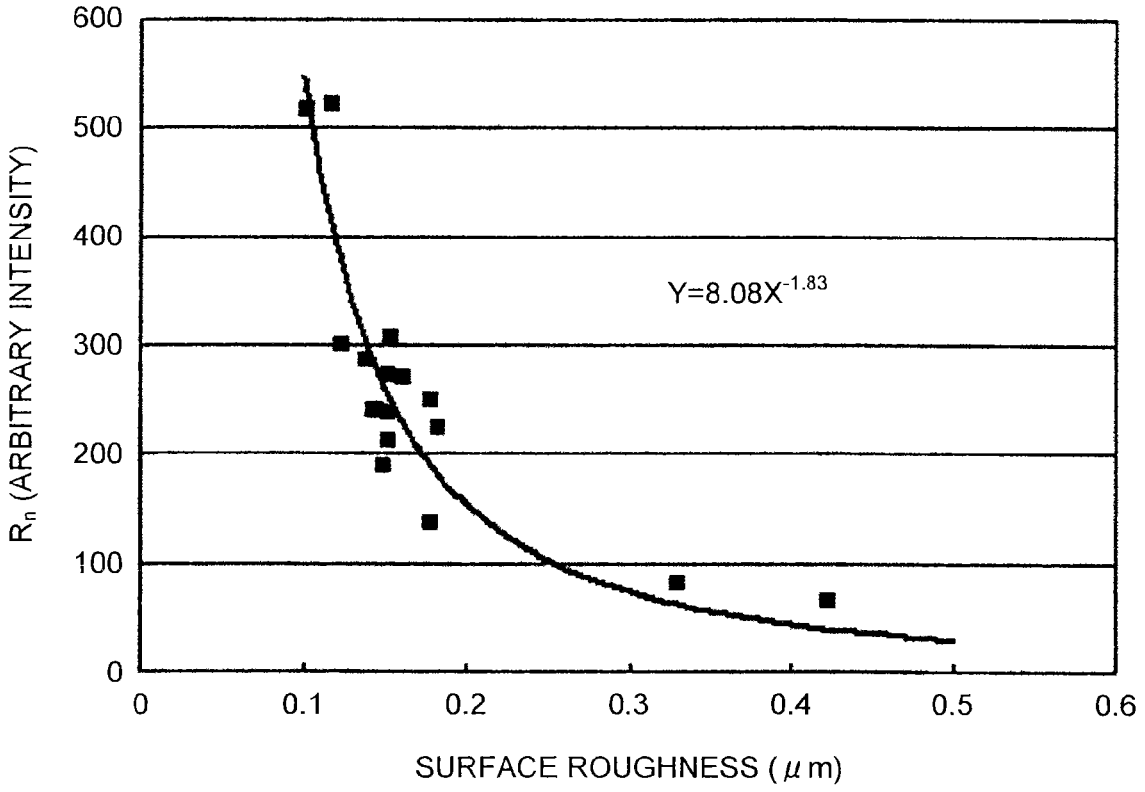
FIG. 17 is a graph illustrating the relation between the detection value obtained by the reflective optical sensor and the surface roughness of the fixing belt.

FIG. 17 also illustrates a graph representing the relation between $R_n$ (arbitrary intensity) as a sensor detection value and results obtained by measuring surface roughness on the fixing belt 61 using a surface roughness meter. The surface roughness illustrated in this example is an average value of surface roughness on a certain region on the fixing belt 61. As can be seen from FIG. 17, the surface roughness of the fixing belt 61 and $R_n$ as the sensor detection value establish a correlation, which well fits to an exponential function. In view of this, from the sensor detection values of the flaw-free part and the flaw part on the surface of the fixing belt 61, the difference in surface roughness between the flaw-free part and the flaw part can be calculated.

FIG. 17 reveals that when the surface roughness of the surface of the fixing belt 61 is 0.4 μm or more, the change in the sensor detection value is very small. In view of this, when the surface of the fixing belt 61 is roughened by the surface condition changing roller 67 having surface roughness rougher than the surface roughness of the linear flaw on the surface of the fixing belt 61 to make the surface roughness of the surface of the fixing belt 61 0.4 μm or more, the surface roughness of both the flaw part and the flaw-free part is 0.4 μm or more when sheet feeding is performed again and a linear flaw occurs. This makes it difficult to calculate the difference in surface roughness between the flaw part and the flaw-free part using the sensor detection value. In view of this, it is desirable that the surface condition changing roller 67 be selected so that the surface roughness of the surface of the fixing belt 61 is 0.2 μm or more in a condition that the surface of the fixing belt 61 is abraded using the surface condition changing roller 67 and that a new surface is exposed.

The above embodiment detects the position and width of the linear flaw occurring on the fixing belt 61 (fixing member) as the surface information and changes the surface condition of the fixing belt 61 using the surface condition changing roller 67 only when the presence of the flaw is detected. In this way, the life of the fixing belt 61 can be extended while preventing deterioration in the quality of formed images.

Improving the surface condition of the fixing belt 61 can retard the progress of the flaw, extend the exchange intervals of the fixing belt 61, and reduce costs and downtime.

By controlling the time during which the surface condition changing roller 67 is brought into contact with the surface of the fixing belt 61 to rub the surface, a surface condition can be changed according to the flaw level.

By detecting again the surface information of the fixing belt 61 after changing the surface condition of the fixing belt 61, the degree of change in the surface condition can be checked and a favorable surface condition can be surely obtained.

The reflective optical sensor 200 has the detection region A in the direction parallel to the width direction of the fixing belt 61, and it can be relatively less precisely arranged. One reflective optical sensor 200 is arranged corresponding only to the contact range W2, and the surface information of the fixing belt 61 can be favorably detected without being affected by variations in the characteristics or variations in installation of the reflective optical sensor 200 compared with a case in which a plurality of reflective optical sensors 200 are used. Although the fixing belt 61 using a material having high surface hardness such as PFA for its surface layer is likely to be damaged, the surface information can be detected more surely by the reflective optical sensor 200, thereby facilitating management such as belt replacement.

The reflective optical sensor 200 can detect the flaw level (the depth of the flaw and the width of the flaw) of the linear flaw caused by the contact between the transfer sheet S and the surface of the fixing belt 61 and the position of the flaw simultaneously. The reflective optical sensor 200 sequentially applies the LEDs 211 in one direction in the width direction of the fixing belt 61, and crosstalk (receiving reflected light from the LEDs 211 simultaneously when viewed from one PD 212) does not occur compared with a case in which the LEDs 211 turn on simultaneously, thereby improving the detection accuracy of obtained detection results corresponding to the respective optical spots.

Figure 18:
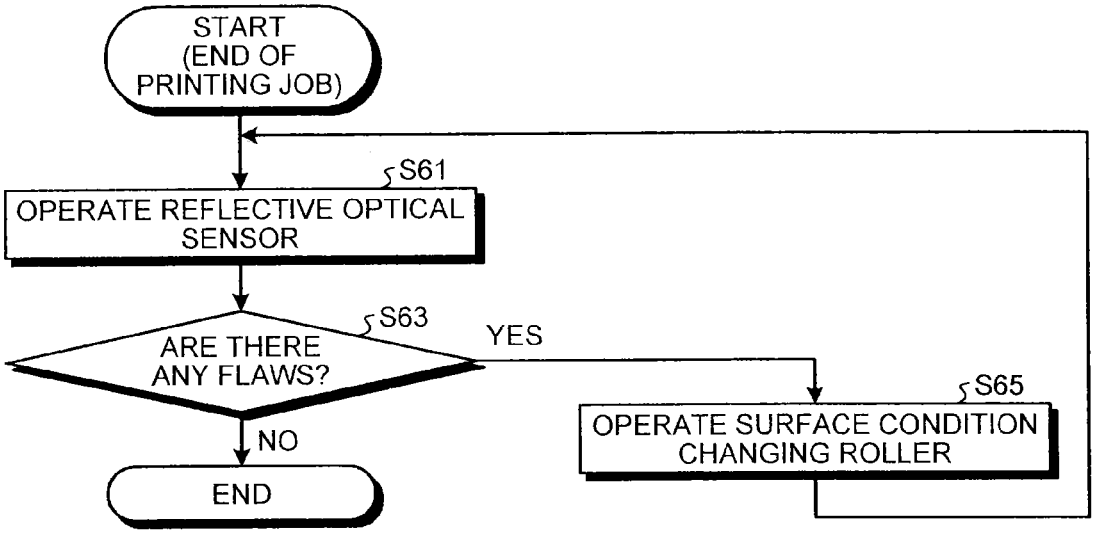
FIG. 18 is a flow diagram explaining a modification (No. 1) of the operation for changing the surface condition of the fixing belt.

The constitution, control, and the like of the devices in the above embodiment can be appropriately changed. The surface condition changing operation by the surface condition changing roller 67 can also be the mode as illustrated in FIG. 18, for example. In the modification of the surface condition changing operation illustrated in FIG. 18, when the printing job ends (the image forming process ends), at Step S61, the reflective optical sensor 200 is operated in accordance with the flow diagram of FIG. 5 with the fixing belt 61 rotated. When the operation of the reflective optical sensor 200 ends, the surface information detector 300 performs the processing at Step S63 to detect (determine) the surface condition of the fixing belt 61 in accordance with the flow diagram illustrated in FIG. 6. As a result of this determination, if there is no flaw (No at Step S63), the process of surface condition changing control ends without driving the surface condition changing roller 67. In contrast, if the surface information detector 300 detects the presence of a flaw on the fixing belt 61 (Yes at Step S63), at Step S65, receiving the detection result from the reflective optical sensor 200, the surface condition changing controller 400 controls the operation of the surface condition changing roller 67 in the same manner as the above case (refer to FIG. 15).

After the end of the operation of the surface condition changing roller 67 at Step S65, at Step S61 again, the reflective optical sensor 200 is operated to determine the surface condition of the fixing belt 61. For the control of this operation, as illustrated in FIG. 1C, the surface condition changing controller 400 is configured to be capable of controlling the reflective optical sensor 200 and the surface information detector 300. Thus, whether the surface condition of the fixing belt 61 has been changed to a flaw-free state can be checked. The reflective optical sensor 200 can check not only the position of the flaw but also whether a flaw-free, uniform condition has been achieved in all the illuminated regions. If the flaw still remains after checking, the surface condition changing roller 67 can be operated again to repeat the series of operation until the linear flaw disappears. Thus, a flaw-free condition can be surely achieved on the fixing belt 61.

Figure 19:
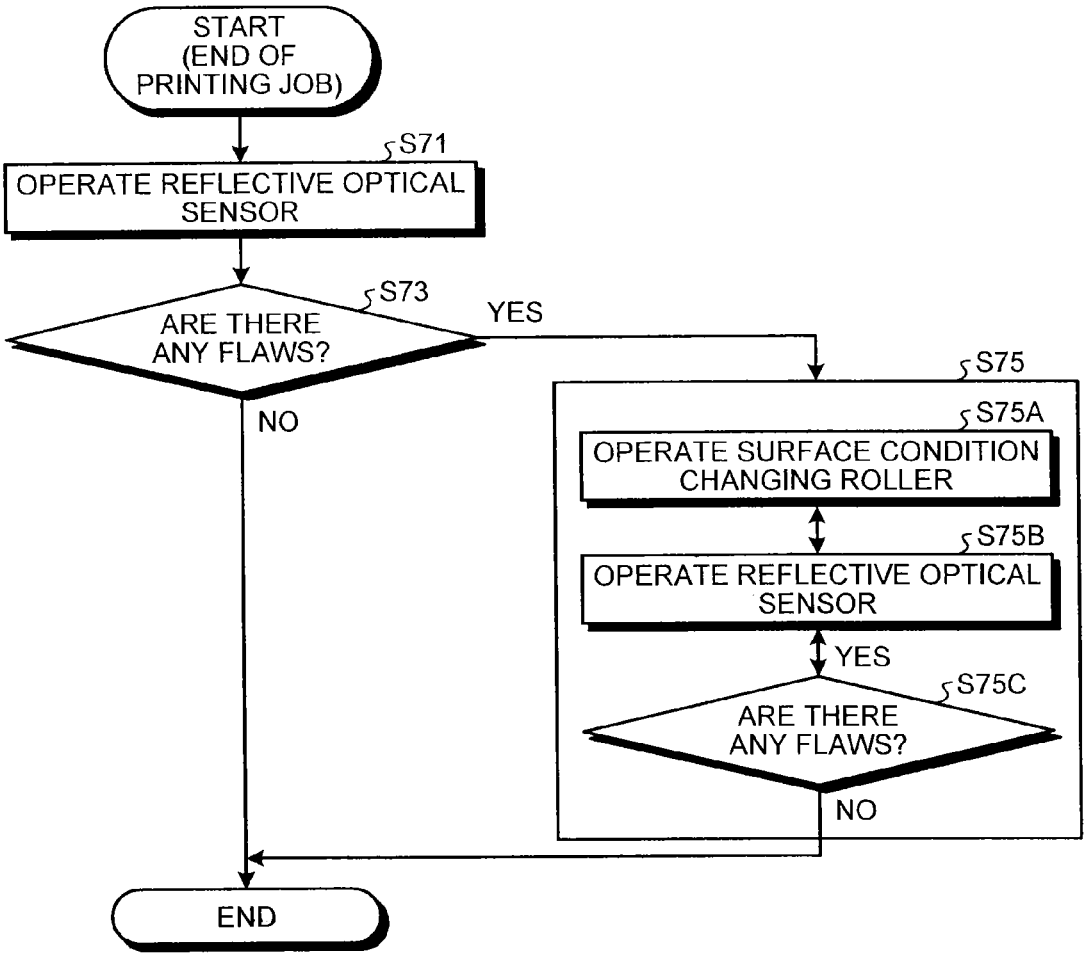
FIG. 19 is a flow diagram explaining a modification (No. 2) of the operation for changing the surface condition of the fixing belt.

The surface condition changing operation can also be the mode as illustrated in FIG. 19. In the modification illustrated in FIG. 19, when the printing job ends (the image forming process ends), at Step S71, the reflective optical sensor 200 is operated in accordance with the flow diagram of FIG. 5 with the fixing belt 61 rotated. When the operation of the reflective optical sensor 200 ends, the surface information detector 300 performs the processing at Step S73 to detect (determine) the surface condition of the fixing belt 61 in accordance with the flow diagram illustrated in FIG. 6. As a result of this determination, if there is no flaw (No at Step S73), the process of surface condition changing control ends without driving the surface condition changing roller 67.

In contrast, if the surface information detector 300 detects the presence of a linear flaw on the fixing belt 61 (Yes at Step S73), at Step S75, receiving the detection result from the reflective optical sensor 200, the surface condition changing controller 400 drivingly controls the operation of the surface condition changing roller 67. At Step S75, the surface condition changing roller 67 is drivingly controlled in accordance with the flow diagram illustrated in FIG. 15. In this situation, in parallel with the rotating drive of the surface condition changing roller 67 (Step S75A), the reflective optical sensor 200 is also operated (Step S75B), and the surface condition of the fixing belt 61 is determined in real time (Step S75C). In other words, the surface condition changing roller 67 is rotatingly driven while determining the surface condition, and the rotating drive is continued until it is determined that there is no flaw. If a flaw-free state is detected at Step S75C, the surface condition changing roller 67 is separated from the fixing belt 61, its rotating drive is stopped, the operation of the reflective optical sensor 200 ends, and surface condition changing process ends. This can surely provide the surface of the fixing belt 61 with a free-flaw surface condition by minimum necessary rotating drive of the surface condition changing roller 67. This modification detects the surface condition of the fixing belt 61 while changing the surface condition of the fixing belt 61, thereby checking the degree of change of the surface condition at all times and surely obtaining a favorable surface condition by minimum necessary operation of the surface condition changing roller 67 (with the deterioration of the fixing belt 61 reduced to a minimum).

Figure 20:
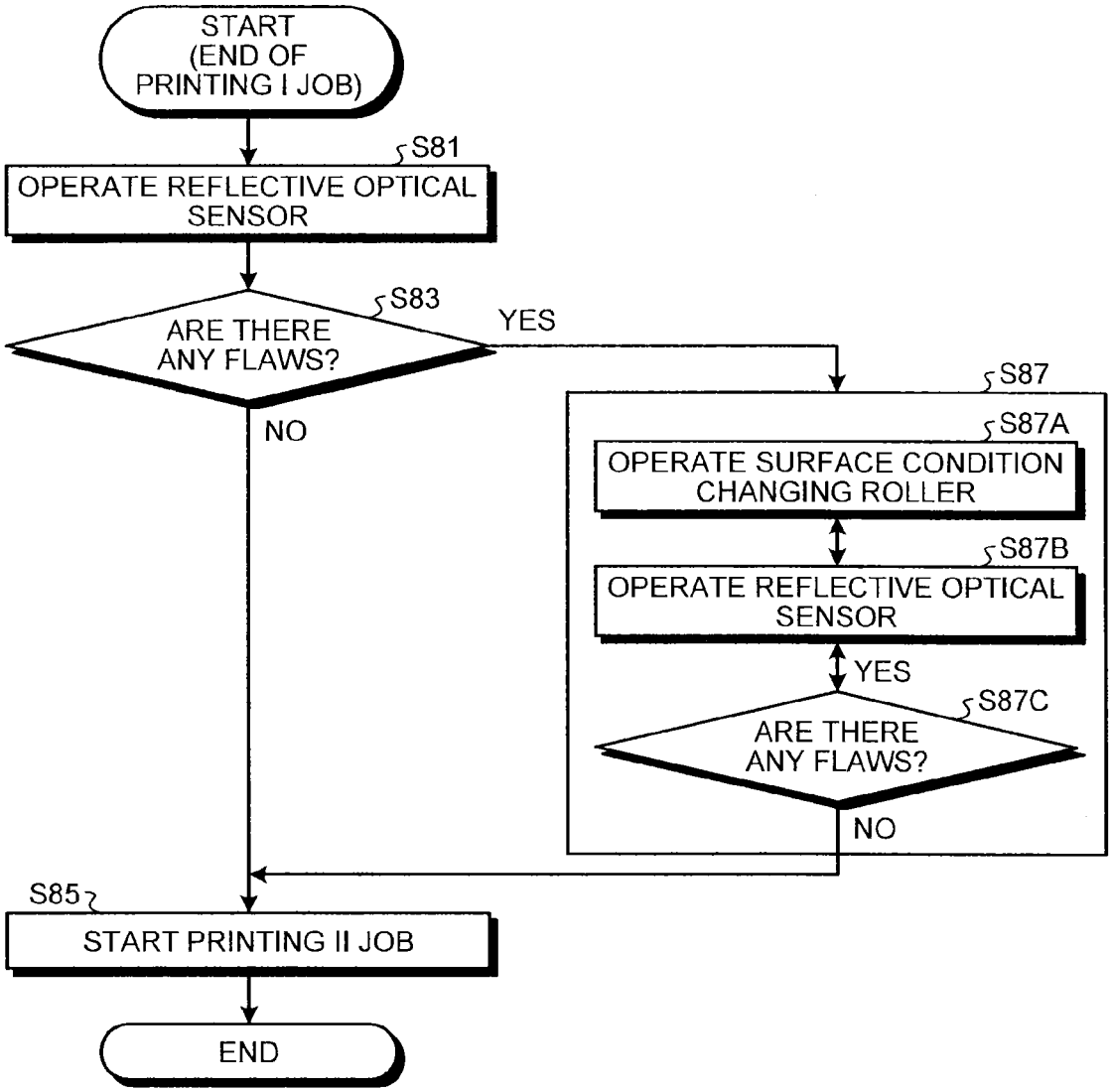
FIG. 20 is a flow diagram explaining a modification (No. 3) of the operation for changing the surface condition of the fixing belt.

The surface condition changing operation can also be the mode as illustrated in FIG. 20. In the modification illustrated in FIG. 20, printing I is performed on a sheet whose width in the main-scanning direction is small, and after the end of its printing job, printing II is performed for a sheet whose width in the main-scanning direction is larger than that of printing I. In the present modification, after the end of the printing I job (the end of the image forming process), at Step S81, the reflective optical sensor 200 is operated in accordance with the flow diagram of FIG. 5 with the fixing belt 61 rotated. After the end of the operation of the reflective optical sensor 200, at Step S83, the surface information detector 300 detects (determines) the surface condition of the fixing belt 61 in accordance with the flow diagram illustrated in FIG. 6. As a result of this determination, if there is no flaw (No at Step S83), without driving the surface condition changing roller 67, a printing II job is started at Step S85.

In contrast, if the surface information detector 300 detects the presence of a linear flaw on the fixing belt 61 (Yes at Step S83), at Step S87, receiving the detection result from the reflective optical sensor 200, the surface condition changing controller 400 drivingly controls the operation of the surface condition changing roller 67. At Step S87, the surface condition changing roller 67 is drivingly controlled in accordance with the flow diagram illustrated in FIG. 15. In this situation, in parallel with the rotating drive of the surface condition changing roller 67 (Step S87A), the reflective optical sensor 200 is also operated (Step S87B), and the surface condition of the fixing belt 61 is determined in real time (Step S87C). In other words, the surface condition changing roller 67 is rotatingly driven while determining the surface condition, and the rotating drive is continued until it is determined that there is no flaw. If a flaw-free state is detected at Step S87C, the surface condition changing roller 67 is separated from the fixing belt 61, its rotating drive is stopped, the operation of the reflective optical sensor 200 ends, and the printing II job is started at Step S85.

Figure 21:
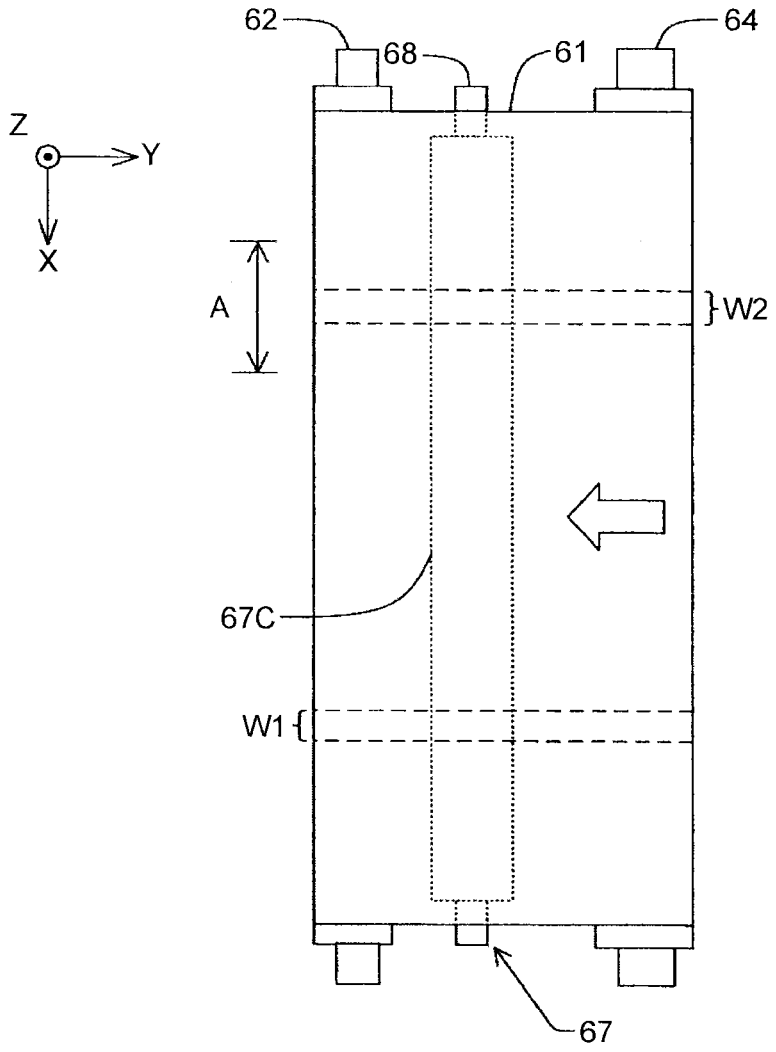
FIG. 21 is a diagram illustrating a modification of the surface condition changing roller.

FIG. 21 illustrates a modification of the surface condition changing roller. In the modification illustrated in FIG. 21, a surface condition changing roller 67C has a length slightly longer than a large-sized sheet width passing over the fixing belt 61, thereby changing the surface condition across substantially the entire widthwise region of the fixing belt 61. This can not only abrade the linear flaw formed on the fixing belt 61 caused by rubbing with the widthwise both ends of the transfer sheet to improve the surface condition of the fixing belt 61 but also uniformly improve the surface condition of the fixing belt 61 across substantially the entire widthwise region of the fixing belt 61, thereby effectively changing the surface condition also against flaws caused by the separating claws or the temperature sensor, or against the offset.

Although the surface information detector 300 of the above embodiment calculates the sum of the detection signals (refer to Step S21) each time the detection signal of the PDs 212 is received, that is not a limited example. The reflective optical sensor 200 can simultaneously turn on the LEDs 211, for example, and in synchronization with the simultaneous lighting of the LEDs 211, the PDs 212 may receive the respective beams of reflected light. In this case, the surface information detector 300 may use the detection results $R_n$ of the respective PDs $\mathbf{212}_n$ corresponding to the respective LEDs $\mathbf{211}_n$ without summing the detection signals to obtain the reflected light intensity $R_n$ for a plurality of positions spaced apart from each other in the width direction on the surface of the fixing belt 61.

Although the above embodiment describes a case in which the surface information caused by the linear flaw on the fixing belt 61 is a main object to be detected, the object to be detected is not limited thereto and may be the offset or a flaw caused by the contact with the thermister or the separating claws. For the offset, for example, when the condition of toner adhering to the surface of the fixing belt 61 is film-like, a decrease in the reflected light intensity $R_n$ as a detection result is relatively small and extends across a wide region, and the offset can be detected by these characteristics. While the width of the linear flaw is several hundreds of micrometers to several millimeters, the width of the flaw caused by the contact with the thermister or the separating claws is several tens of micrometers to several hundreds of micrometers, and its occurrence position is substantially fixed, thereby distinguishing it from the linear flaw based on its detection position and the width of the flaw.

Although the above embodiment describes a case in which the fixing member is the fixing belt 61, the fixing member is not limited thereto and may be a fixing roller, for example.

Although in the above embodiment the surface condition changing roller 67 comes into contact with and separates from the fixing belt 61 and rubs thereagainst through a part of the fixing belt 61 not being in contact with the fixing roller 64, the surface condition changing roller 67 may do so through a part being in contact with the fixing roller 64.

The mode of the reflective optical detector is not limited to the reflective optical sensor 200 in the above embodiment and is only required to apply a plurality of beams of light in the width direction of the fixing belt 61 and receive their reflected light. Although the reflective optical sensor 200 in the above embodiment is an array type in which the LEDs 211 and the PDs 212 face each other on a one-to-one basis, the reflective optical detector is not limited thereto. For example, a light deflection type is also possible in which a laser is deflected by a light deflector, and reflected light from the surface of the fixing belt 61 is received by one or more PDs. A sensor drive type is also possible in which an optical sensor including one LED and one PD is moved in the width direction of the fixing belt 61 by a drive unit.

The reflective optical sensor 200 is not limited to the constitution of the above embodiment. The reflective optical sensor may have a structure, for example, having N (≥1) LEDs 211 arranged in one direction, M (N≥M≥1) lenses that focus beams of light from the N respective LEDs 211 onto the surface of the fixing belt 61 to form optical spots, and K (N≥K≥1) photosensors that receive beams of reflected light from the fixing belt 61 on the respective optical spots. In this case, the LEDs 211 correspond to one condensing lens, thereby simplifying the structure of a condensing lens array. In such a case, the photosensor may have a single light-receiving plane. A larger condensing lens can serve also as a light-receiving lens for the photosensor.

Although the transfer method in the color printer 100 in the above embodiment is a method in which color toner images formed on the respective photosensitive drums 20Y to 20B are sequentially superimposed on the transfer belt 11 to be primarily transferred, and the transferred color toner images are transferred in a batch onto the transfer sheet S by the secondary transfer roller 17, the transfer method is not limited thereto. A method is also possible that carries and conveys the transfer sheet S onto the transfer belt 11, brings the transfer sheet S into face contact with the respective photosensitive drums, and directly superimposes and transfers the respective color toner images from the respective photosensitive drums onto the transfer sheet S, for example. Also in this case, the fixing of the color toner images may be performed in the same manner as the above embodiment.

When the color printer 100 is capable of printing transfer sheets of a plurality of sizes including an A3 size, an A4 size, and an A5 size, the maximum feedable transfer sheet is the A3 size, which is frequently conveyed in portrait orientation. In this case, surface information for linear flaws by transfer sheets of sizes other than the A3 size is an object to be detected. When the color printer 100 can feed a sheet of an A2 size in a portrait orientation, surface information for linear flaws by transfer sheets of sizes other than the A2 size is an object to be detected. In the present specification, a case when the A4-sized transfer sheet is conveyed in portrait orientation and a case when the A4-sized transfer sheet is conveyed in landscape orientation, for example, mean that the same-sized transfer sheets are conveyed with different widths. This case also means that sheet-shaped recording media having different widths and a plurality of sizes are conveyed.

Although the above embodiment describes a case in which the image forming apparatus is a color printer, the image forming apparatus is not limited thereto and may be, for example, a monochrome copier, a color copier, a facsimile machine, a plotter, or what is called a multi function printer (MFP) that combines the functions of these machines.

The present invention can optimize the amount of abrasion of a fixing member and extend the life of the fixing member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device that fixes a toner image carried on a sheet-shaped recording medium onto the sheet-shaped recording medium, the fixing device comprising:

a fixing member that relatively moves, with a surface thereof being in contact with the toner image during a fixing operation, in a first direction with respect to the sheet-shaped recording medium;

a surface information detecting device that determines surface information of the fixing member including information on a flaw formed on the surface of the fixing member;

a surface condition changing device that is contactable with and separable from the fixing member and that abrades the surface of the fixing member in contact with the surface condition changing device; and a surface condition changing controller that controls contact and separation of the surface condition changing device with and from the fixing member based on a detection result obtained by the surface information detecting device.

2. The fixing device according to claim 1, wherein the surface information of the fixing member determined by the surface information detecting device includes at least one piece of information on the position of a linear flaw formed on the surface of the fixing member, information on the width of the flaw, and information on the depth of the flaw.

3. The fixing device according to claim 1, wherein the fixing member performs the fixing operation on the sheet-shaped recording medium having a plurality of sizes that are different in a size in a second direction orthogonal to the first direction, and the surface condition changing controller controls the abrading of the surface of the fixing member by controlling the surface condition changing device when the size of the sheet-shaped recording medium is changed to a larger size.

4. The fixing device according to claim 1, wherein the surface condition changing controller controls a contact time of the surface condition changing device with the fixing member.

5. The fixing device according to claim 1, wherein the surface condition changing device abrades, on the surface of the fixing member, an entire region of a contact range between the sheet-shaped recording medium and the fixing member with respect to a second direction orthogonal to the first direction.

6. The fixing device according to claim 5, wherein the fixing member performs the fixing operation on the sheet-shaped recording medium having a plurality of sizes that are different in a size in the second direction orthogonal to the first direction, and the surface condition changing device abrades, on the surface of the fixing member, an area being in contact with the end of the sheet-shaped recording medium not having the largest size.

7. The fixing device according to claim 1, wherein the surface condition changing device abrades, on the surface of the fixing member, an area being in contact with an end of the sheet-shaped recording medium with respect to the second direction orthogonal to the first direction.

8. The fixing device according to claim 1, wherein the surface information detecting device further determines the surface information of the fixing member at the same time as or after an operation to abrade the surface of the fixing member.

9. The fixing device according to claim 1, wherein the surface information detecting device includes a reflective optical detecting device that sequentially applies a plurality of beams of measurement light to the fixing member in a direction crossing the first direction and determines the surface information of the fixing member based on reflected beams of measurement light.

10. An image forming apparatus, comprising:

a developing device that forms one or more types of toner images by an electrophotographic process;

a transfer device that transfers the toner images onto a sheet-shaped recording medium; and the fixing device according to claim 1 that fixes the toner images carried on the sheet-shaped recording medium onto the sheet-shaped recording medium.

11. A fixing device that fixes a toner image carried on a sheet-shaped recording medium onto the sheet-shaped recording medium, the fixing device comprising:

a rotatable fixing structure that relatively moves, with a surface thereof being in contact with the toner image during a fixing operation, in a first direction with respect to the sheet-shaped recording medium;

a roller that is contactable with and separable from the fixing structure and that abrades the surface of the fixing structure in contact with the roller; and circuitry configured to:

determine surface information of the fixing structure including information on a flaw formed on the surface of the fixing structure, and control contact and separation of the roller with and from the fixing structure based on the surface information determined.

* * * * *